US010434786B2

(12) United States Patent
Fukasawa et al.

(10) Patent No.: US 10,434,786 B2
(45) Date of Patent: Oct. 8, 2019

(54) LIQUID SUPPLY UNIT

(71) Applicant: Seiko Epson Corporation, Tokyo (JP)

(72) Inventors: Noriyuki Fukasawa, Shiojiri (JP); Taku Ishizawa, Matsumoto (JP); Yoshiaki Shimizu, Matsumoto (JP); Satoshi Shinada, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/066,293

(22) PCT Filed: Nov. 18, 2016

(86) PCT No.: PCT/JP2016/084213
§ 371 (c)(1),
(2) Date: Jun. 26, 2018

(87) PCT Pub. No.: WO2017/115582
PCT Pub. Date: Jul. 6, 2017

(65) Prior Publication Data

US 2019/0016146 A1 Jan. 17, 2019

(30) Foreign Application Priority Data

Dec. 28, 2015 (JP) ..... 2015-256027

(51) Int. Cl.
*B41J 2/175* (2006.01)
*B41J 2/06* (2006.01)
(Continued)

(52) U.S. Cl.
CPC ..... *B41J 2/17523* (2013.01); *B41J 2/06* (2013.01); *B41J 2/1707* (2013.01); *B41J 2/1752* (2013.01);
(Continued)

(58) Field of Classification Search
CPC . B41J 2/06; B41J 2/1629; B41J 2/1707; B41J 2/17509; B41J 2/17513;
(Continued)

(56) References Cited

U.S. PATENT DOCUMENTS 5,448,274 A * 9/1995 Hirabayashi ..... B41J 2/17513 347/50
6,196,670 B1 * 3/2001 Saruta ..... B41J 2/16526 347/86
6,511,167 B1 * 1/2003 Kitabatake ..... B41J 2/17503 347/86
(Continued)

FOREIGN PATENT DOCUMENTS

CN 204249558 4/2015
CN 205130629 4/2016
(Continued)

OTHER PUBLICATIONS

International Search Report dated Feb. 14, 2017 for Application No. PCT/JP2016/084213 and English-language translation. (4 pages).

*Primary Examiner* — Anh T Vo
(74) *Attorney, Agent, or Firm* — Foley & Lardner LLP

(57) ABSTRACT

A liquid supply unit that includes a liquid ejection apparatus and configured to be mounted onto a holder unit that has a liquid introducing needle that extends in a first direction includes an outer shell, a liquid supply port, and an engagement structure including a first engagement portion, in which the first engagement portion is disposed on a mounting direction side of the outer shell at a position that overlaps with the outer shell when the liquid supply unit is viewed from the demounting direction side.

9 Claims, 18 Drawing Sheets

(51) Int. Cl.

| | |
|---|---|
| ***B41J 2/17*** | (2006.01) |
| ***B41J 29/393*** | (2006.01) |
| ***B41J 29/13*** | (2006.01) |
| *B41J 2/16* | (2006.01) |

(52) U.S. Cl.
CPC ..... *B41J 2/1753* (2013.01); *B41J 2/1755* (2013.01); *B41J 2/17509* (2013.01); *B41J 2/17513* (2013.01); *B41J 2/17553* (2013.01); *B41J 2/17596* (2013.01); *B41J 29/13* (2013.01); *B41J 29/393* (2013.01); *B41J 2/1629* (2013.01); *B41J 2002/062* (2013.01)

(58) Field of Classification Search
CPC .... B41J 2/1752; B41J 2/17523; B41J 2/1755; B41J 2/17553; B41J 2/17596; B41J 29/13; B41J 29/393; B41J 2002/062
See application file for complete search history.

(56) References Cited

U.S. PATENT DOCUMENTS

| | | | | |
|---|---|---|---|---|
| 7,258,431 | B2 * | 8/2007 | Shinada | B41J 2/17513 347/50 |
| 9,205,661 | B2 | 12/2015 | Kawate | |
| 2012/0249691 | A1 * | 10/2012 | Takagi | B41J 2/1752 347/86 |
| 2016/0059575 | A1 | 3/2016 | Nakata | |

FOREIGN PATENT DOCUMENTS

| | | | |
|---|---|---|---|
| JP | S63-178141 | U | 11/1988 |
| JP | 3-108557 | A | 5/1991 |
| JP | 07-025029 | | 1/1995 |
| JP | 2005-74749 | A | 3/2005 |
| JP | 2013-248779 | A | 12/2013 |
| JP | 2015-047836 | | 3/2015 |
| JP | 2016-049771 | A | 4/2016 |

* cited by examiner

CROSS-SECTIONAL VIEW ALONG LIKE F2-F2

LIQUID SUPPLY UNIT

CROSS-REFERENCE TO RELATED APPLICATIONS

This application is a national phase entry of International Application No. PCT/JP2016/084213 filed Nov. 18, 2016; which claims priority to Japanese Appl. No. 2015-256027 filed Dec. 28, 2015; the disclosures of all of which are incorporated by reference herein in their entirety.

BACKGROUND

Technical Field

The present invention relates to a technology for a liquid supply unit.

Related Art

There is known an ink cartridge that can be mounted onto a holder of a printer (for example, Patent Literature 1).

PRIOR ART DOCUMENTS

Patent Literature

[Patent Literature 1] JP 2013-248779 A

A conventional ink cartridge includes an ink supply port that can connect to an ink supply needle of a holder, and a lever provided on a side surface of the ink cartridge that can engage with a concave portion of the holder. Movement of the ink cartridge in a demounting direction is restricted by the lever engaging with the concave portion of the holder.

However, in conventional ink cartridges, the member for restricting movement in the demounting direction is provided on a side surface (one side) that intersects with a mounting direction. With this configuration, in a mounting state in which the ink cartridge is mounted onto the holder, the ink cartridge may incline from a correct mounting posture due to another side surface of the ink cartridge moving in the demounting direction from the holder. Such a problem is not limited to an ink cartridge that can be mounted onto a printer and also applies to liquid supply units for other types of liquid ejection apparatus. Existing technology is also required to be achieve lower cost, use less resources, be easier to manufacture, and be easier to use.

SUMMARY

The present invention has been made in order to at least partly solve the above-described problems and may be implemented as the following aspects or application examples.

(1) According to one aspect of the present invention, there is provided a liquid supply unit that includes a liquid ejection apparatus and configured to be mounted onto a holder unit that has a liquid introducing needle that extends in a first direction. This liquid supply unit includes an outer shell; a liquid supply port disposed in the outer shell, the liquid supply port is configured to connect to the liquid introducing needle; and an engagement structure including a first engagement portion, the first engagement portion is configured to restrict movement in a demounting direction through engaging with the holder unit, the demounting direction opposite to a mounting direction parallel to the first direction, the mounting direction is a direction of mounting the liquid supply unit onto the holder unit, in which the first engagement portion is disposed on a mounting direction side of the outer shell at a position that overlaps with the outer shell when the liquid supply unit is viewed from the demounting direction side.

According to this aspect, because the first engagement portion is disposed at a position that overlaps with the outer shell when the liquid supply unit is viewed from the demounting direction side, the possibility of the liquid supply unit inclining in the mounting state can be reduced, compared to a case in which the first engagement portion is disposed at a position that does not overlap with the outer shell. In addition, because the first engagement portion is disposed on the mounting direction side of the outer shell, the liquid supply unit can be prevented from increasing in size in a direction orthogonal to the mounting direction.

(2) In the above-described aspect, the liquid supply port may be disposed on one side in a second direction orthogonal to the mounting direction, and the first engagement portion may be disposed on an other side in the second direction in a mounting state in which the liquid supply unit is mounted onto the holder unit.

According to this aspect, the first engagement portion and the holder unit can engage with each other on the other side in the second direction while the liquid supply port and the liquid introducing needle connect to each other on the one side in the second direction.

(3) In the above-described aspect, the liquid supply unit may further include a second engagement portion that is disposed on the one side and that is configured to restrict movement of the liquid supply unit in the demounting direction through engaging with the holder unit.

According to this aspect, movement in the demounting direction on the one side can be restricted with the second engagement portion and movement in the demounting direction on the other side can be restricted with the first engagement portion. With this configuration, the possibility of the liquid supply unit inclining in the mounting state can be further reduced.

(4) In the above-described aspect, the engagement structure may further include an operation portion used for operating engagement between the first engagement portion and the holder unit.

According to this aspect, the operation portion can be used to easily engage the first engagement portion and the holder unit with each other.

(5) In the above-described aspect, the operation portion may protrude outward from a portion of the outer shell different to a tip end portion that faces a direction including a mounting direction component.

According to this aspect, the operation portion protrudes outward from a portion different to the tip end portion, and hence the user can easily operate the operation portion.

(6) In the above-described aspect, the operation portion may protrude outward in a direction including a demounting direction component from a portion of the outer shell that faces a direction including a demounting direction component.

According to this aspect, the operation portion protrudes outward in a direction including a demounting direction component, and hence the user can easily operate the operation portion.

(7) In the above-described aspect, the engagement structure may further include a connecting portion that connects the first engagement portion and the operation portion to each other and that forms a fulcrum about which the first engagement portion and the operation portion rotatably move.

According to this aspect, the operation portion and the first engagement portion can be displaced about a fulcrum.

(8) In the above-described aspect, the liquid supply unit may further include a unit-side terminal that is disposed on one side of the outer shell in a second direction orthogonal to the mounting direction and is configured to electronically connect to a holder-side terminal of the holder unit; and a third engagement portion that is arranged between the liquid supply port and the first engagement portion in the second direction and that is configured to restrict movement of the liquid supply unit from one side to an other side in the second direction through engaging with the holder unit, in which, in the mounting state of mounting the liquid supply unit onto the holder unit, the unit-side terminal is subject to a force from the one side to the other side from the holder-side terminal.

According to this aspect, the liquid supply unit in the mounting state can be restricted from moving from the one side to the other side by providing the third engagement portion.

(9) In the above-described aspect, the outer shell includes a first wall portion on which the liquid supply port is disposed; a second wall portion located on the demounting direction side opposing the first wall portion; a third wall portion that intersects with the first wall portion and the second wall portion and is located on one side in the second direction orthogonal to the mounting direction; and a fourth wall portion that intersects with the first wall portion and the second wall portion and is located on the other side in the second direction opposing the third wall portion.

According to this aspect, a liquid supply unit including first to fourth wall portions can be provided.

For example, in one aspect of the present invention, the present invention can also be implemented as an apparatus including one or more of a plurality of elements such as the outer shell, the liquid supply port and the engaged structure. In other words, this apparatus may or may not include the outer shell. In addition, this apparatus may or may not include the liquid supply port. Further, this apparatus may or may not include the engaged structure. These various aspects can solve at least one of a variety of different problems, such as making the apparatus smaller, reducing cost, saving resources, simplifying manufacturing and improving ease of use. The technical features of each of the aspects of the liquid supply unit described above may be partially or entirely applied to this apparatus.

The present invention can be implemented in the form of various aspects other than the liquid supply unit, and may be implemented as a method of manufacturing a liquid supply unit, a liquid ejection system including a liquid supply unit and a liquid ejection apparatus, or the like.

DESCRIPTION OF EXEMPLARY EMBODIMENTS

A. First Embodiment

A-1: Configuration of Liquid Ejection System

Figure 1:
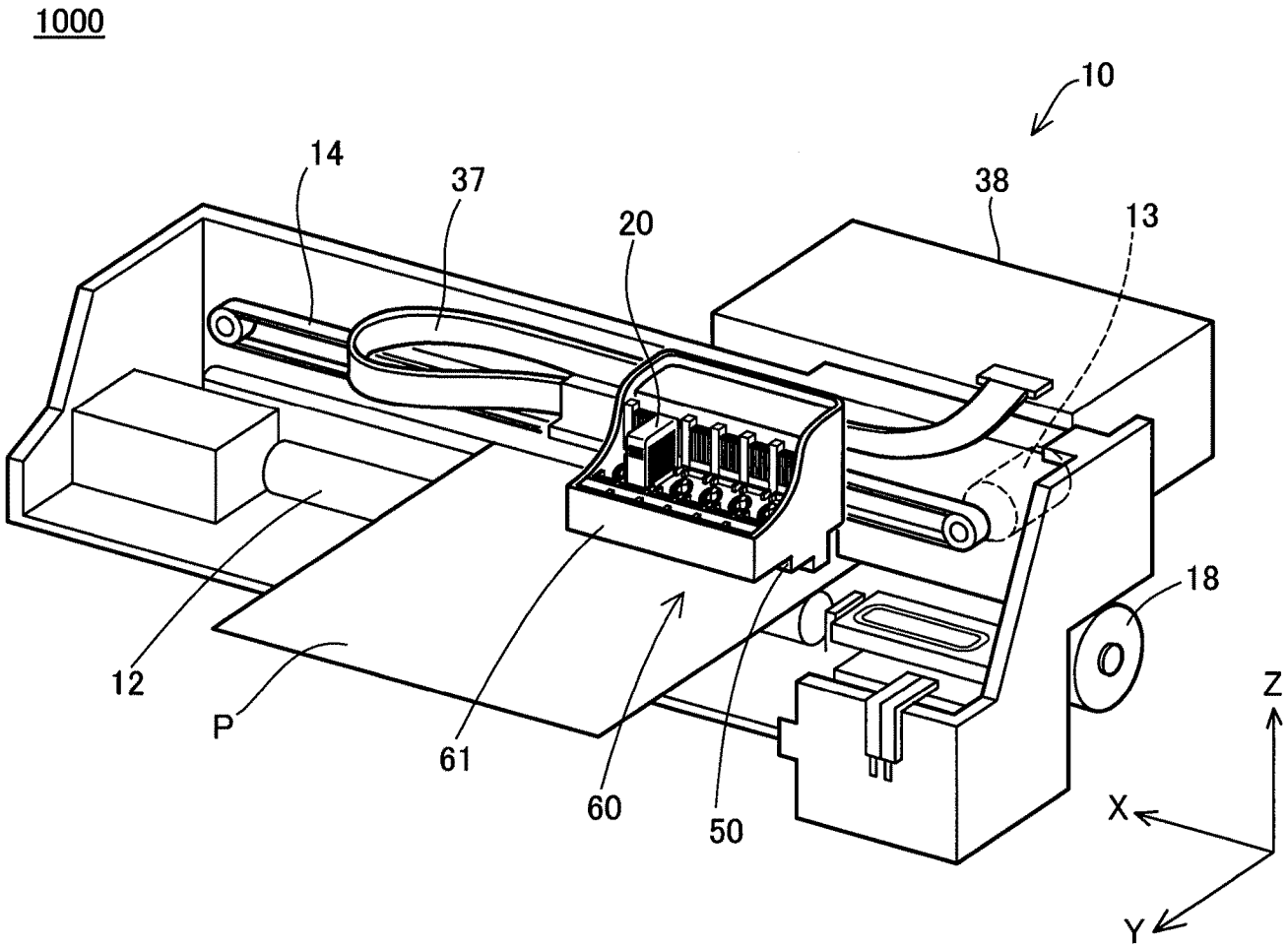
FIG. 1 is a perspective view for illustrating a configuration of a liquid ejection system according to a first embodiment.

FIG. 1 is a perspective view for illustrating the configuration of a liquid ejection system 1000 according to a first embodiment of the present invention. FIG. 1 shows XYZ-axes that are all orthogonal to each other. The XYZ-axes are also shown as needed in other diagrams to follow. The XYZ-axes in FIG. 1 correspond to the XYZ-axes in other diagrams. The liquid ejection system 1000 includes a cartridge 20 as a liquid supply unit and a printer 10 as a liquid ejection apparatus. The printer 10 includes a carriage unit 60. The carriage unit 60 includes a holder unit 61 onto which the cartridge 20 can be mounted and a head unit 50 that can eject ink to the outside. The cartridge 20 is removably mounted onto the holder unit 61 of the printer 10.

The cartridge 20 stores ink therein. The ink stored in the cartridge 20 is supplied to the head unit 50 by flowing through a liquid supply unit and a liquid injecting needle (described later). In this embodiment, a plurality of the cartridges 20 is removably mounted onto the holder unit 61 of the printer 10. In this embodiment, a total of six (only one is shown in FIG. 1) different types of cartridges 20 that each correspond to one of six different colors (black, yellow, magenta, light magenta, cyan and light cyan) are mounted onto the holder unit 61. The number of cartridges 20 to be mounted onto the holder unit 61 is not limited to six.

The printer 10 distributes the ink to the head unit 50 via the liquid injecting needle to be described later by sucking in the ink stored in the cartridge 20 mounted onto the holder unit 61. The head unit 50 has a discharge mechanism such as a piezoelectric element to discharge (supply) the ink to a printing medium P such as paper or a label. With this configuration, data such as characters, shapes and images are printed onto the printing medium P.

A control unit 38 provided in the printer 10 controls each unit of the printer 10. The carriage unit 60 of the printer 10 is configured to move the head unit 50 relative to the printing medium P. The control unit 38 and the carriage unit 60 are electronically connected to each other via a flexible cable 37. The discharge mechanism of the head unit 50 performs a discharge operation on the basis of a control signal transmitted from the control unit 38.

In this embodiment, the holder unit 61 is configured together with the head unit 50 in the carriage unit 60. In this way, in the printer 10, the cartridge 20 is mounted onto the holder unit 61 on the carriage unit 60 that moves the head unit 50. This type of printer is a type that is also referred to as an "on-carriage printer." In other embodiments, the printer 10 may include a stationary holder unit 61 at a place different to the carriage unit 60 and supply the ink from the cartridge 20 mounted onto the holder unit 61 to the head unit 50 via a tube. This type of printer is also referred to as an "off-carriage printer."

The printer 10 further includes a main scanning feed mechanism and a sub-scanning feed mechanism that move a carriage 52 and the printing medium P relative to each other to print on the printing medium P. The main scanning feed mechanism of the printer 10 includes a carriage motor 13 and a drive belt 14. The main scanning feed mechanism moves the carriage unit 60 back and forth in a main scanning direction by transmitting power of the carriage motor 13 to the carriage unit 60 via the drive belt 14. The sub-scanning feed mechanism of the printer 10 includes a transfer motor 18 and a platen 12. The printing medium P is transferred in a sub-scanning direction orthogonal to the main scanning direction by transmitting power of the transfer motor 18 to the platen 12.

In this embodiment, in a usage state (also referred to as "usage orientation") of the liquid ejection system 1000, an axis along the sub-scanning direction (front-back direction) in which the printing medium P is transferred is a Y-axis, an axis along the main scanning direction (left-right direction) in which the carriage unit 60 is moved back and forth is an X-axis, and an axis along a gravity direction (up-down direction) is a Z-axis. The usage state of the liquid ejection system 1000 is a state in which the liquid ejection system 1000 is installed on a horizontal plane. In this embodiment, the horizontal plane is a plane (XY-plane) parallel to both the X-axis and the Y-axis.

In this embodiment, the sub-scanning direction (front direction) is a positive Y-axis direction, a direction opposite to that direction (back direction) is a negative Y-axis direction, a direction (up direction) down to up in the gravity direction is a positive Z-axis direction, and a direction opposite to that direction (down direction) is a negative Z-axis direction. In this embodiment, a direction from the right-side surface to the left-side surface of the liquid ejection system 1000 is a positive X-axis direction (left direction), and a direction opposite to that direction is a negative X-axis direction (right direction). In this embodiment, the arrangement direction of the plurality of cartridges 20 mounted onto the holder unit 61 is a direction (left-right direction, also simply referred to as "X-axis direction") along the X-axis. The direction (back-forth direction) along the X-axis is also referred to as "X-axis direction" and a direction (up-down direction) along the Z-axis is also referred to as "Z-axis direction."

A-2. Configuration of Carriage Unit 60

Figure 2:
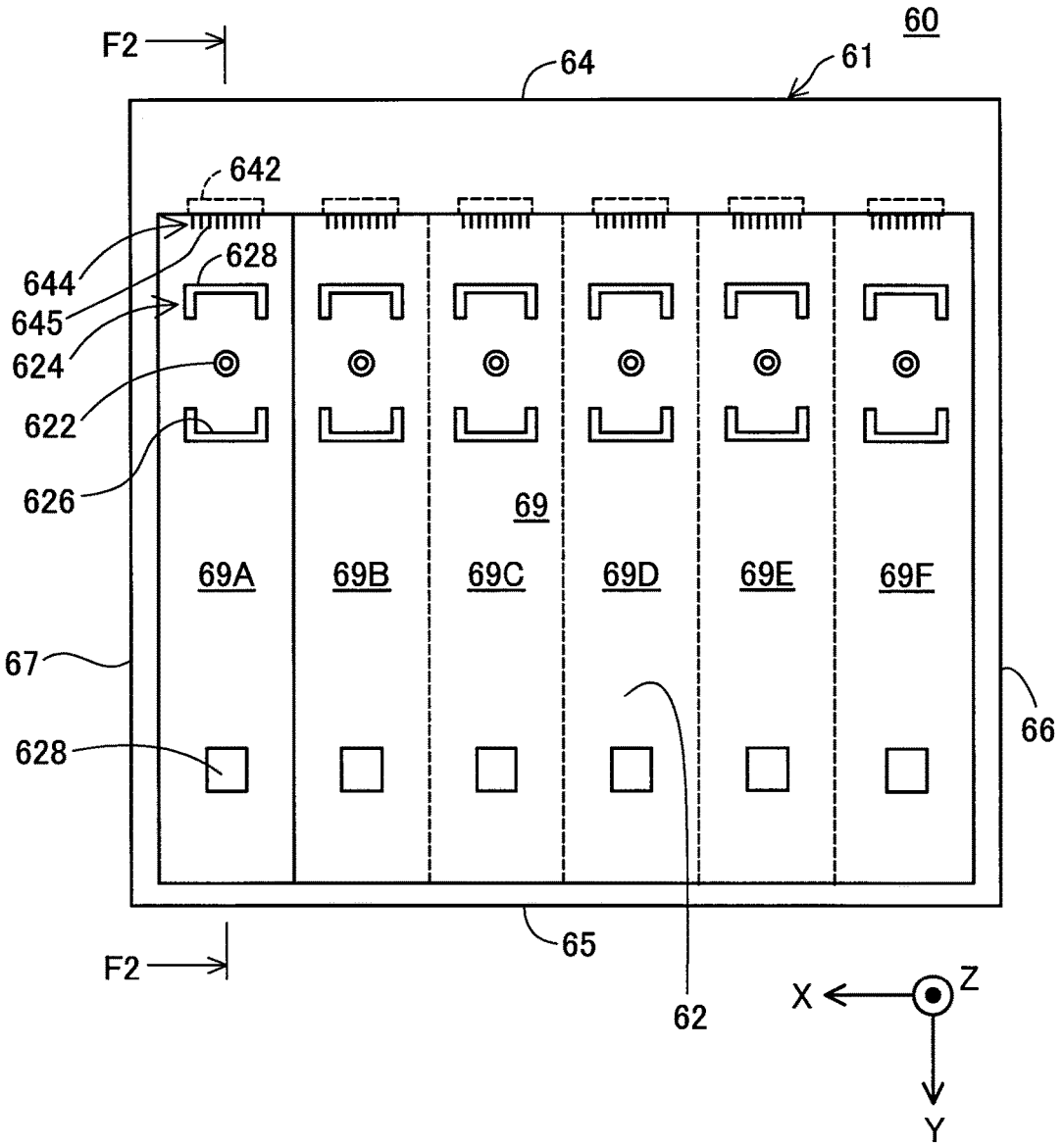
FIG. 2 is a schematic top view for illustrating a carriage unit.
Figure 3:
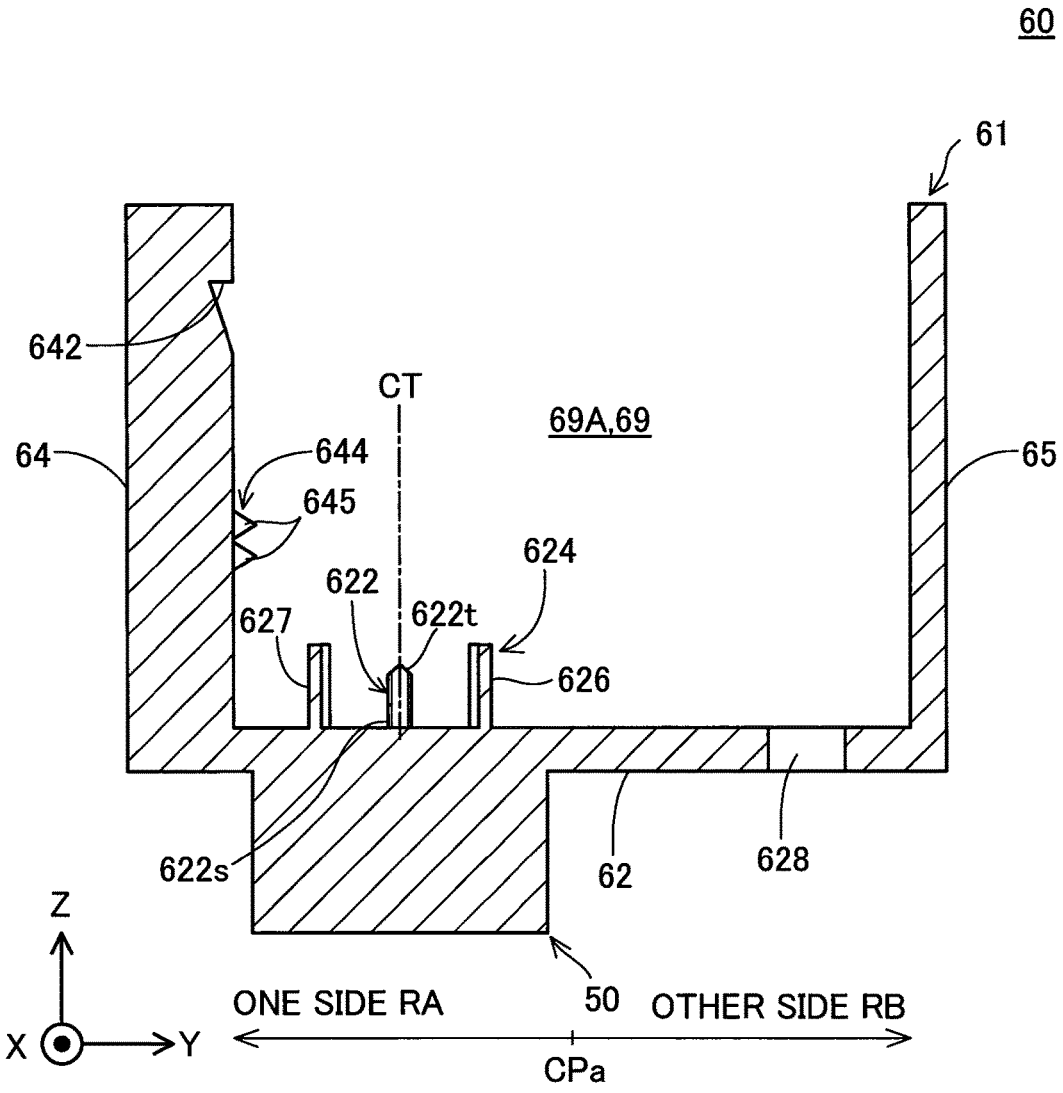
FIG. 3 is a schematic cross-sectional view along the line F2-F2 in FIG. 2.

FIG. 2 is a schematic top view for illustrating the carriage unit 60. FIG. 3 is a schematic cross-sectional view along the line F2-F2 in FIG. 2. The holder unit 61 (FIGS. 2 and 3) includes five wall portions 62, 64, 65, 66 and 67. The wall portion 62 is also referred to as "apparatus front wall portion 62," the wall portion 64 is also referred to as "first side wall portion 64," the wall portion 65 is also referred to as "second side wall portion 65," the wall portion 66 is also referred to as "third side wall portion 66," and the wall portion 67 is also referred to as "fourth side wall portion 67."

The apparatus front wall portion 62 forms a bottom wall of the holder unit 61. The apparatus front wall portion 62 is located on the mounting direction side. As illustrated in FIG. 3, a liquid introducing needle 622 is disposed on the apparatus front wall portion 62. The liquid introducing needle 622 protrudes outward from the apparatus front wall portion 62 in the positive Z-axis direction. A flow passage that allows the ink to flow is formed inside the liquid introducing needle 622. The liquid introducing needle 622 extends in the Z-axis direction as a first direction. The liquid introducing needle 622 includes a base portion 622*s* located on an apparatus front wall portion 62 side and a tip portion 622*t* on a side opposite to the base portion 622*s*. The liquid introducing needle 622 according to this embodiment has a lateral cross section that is substantially circular and a central axis CT that extends in the first direction (Z-axis direction in this embodiment). A direction extending from the base portion 622*s* to the tip portion 622*t* is a positive Z-axis direction, and a direction extending from the tip portion 622*t* to the base portion 622*s* is a negative Z-axis direction. Here, a mounting direction in which the cartridge 20 is mounted onto the holder unit 61 is a negative Z-axis direction. In other words, the mounting direction is a direction parallel to the Z-axis direction as the first direction and, in this embodiment, a gravity downward direction. A demounting direction in which the cartridge 20 is demounted from the holder unit 61 is a positive Z-axis direction. In other words, the demounting direction is a direction parallel to the Z-axis direction as the first direction and, in this embodiment, a gravity upward direction. In this embodiment, a Y-axis direction orthogonal to the mounting direction (negative Z-axis direction) is also referred to as "second direction."

The four wall portions 64, 65, 66 and 67 extend from a peripheral edge portion of the apparatus front wall portion 62 in the positive Z-axis direction (demounting direction). The five wall portions 62, 64, 65, 66 and 67 form a concave portion. This concave portion forms a cartridge storage chamber 69 (also referred to as "cartridge mounting portion 69") that houses the cartridges 20. The cartridge storage chamber 69 includes a plurality of slots (mounting spaces) 69A to 69F that can each receive one of the cartridges 20. The plurality of slots 69A to 69F may be divided by, for example, providing plate-shaped partition walls on the apparatus front wall portion 62.

The first side wall portion 64 and the second side wall portion 65 oppose each other in the Y-axis direction. The third side wall portion 66 and the fourth side wall portion 67 oppose each other in the X-axis direction. In the holder unit 61 according to this embodiment, the Z-axis direction is a height direction, the Y-axis direction is a length direction, and the X-axis direction is a width direction.

The holder unit 61 includes the liquid injecting needle 622 as a liquid injection portion, a first engaged portion 628, a second engaged portion 642, a third engaged structure 624 and an electrode portion 644 for each slot 69A to 69F.

The first engaged portion 628 is a member used for engaging with a corresponding member (first engagement portion) of the cartridge 20. This engagement restricts movement of the cartridge 20 (more specifically, a portion of the cartridge 20 on the positive Y-axis direction side) in the demounting direction in a mounting state in which the cartridge 20 is mounted onto the holder unit 61. The first engaged portion 628 is an opening portion formed in the apparatus front wall portion 62. The shape of the first engaged portion 628 is not limited hereto and may be any shape that achieves engagement with a corresponding member of the cartridge 20. For example, the first engaged portion 628 may be a concave shape formed in the apparatus front wall portion 62.

The third engaged structure 624 is a member used for engaging with a corresponding member (a third engagement structure to be described later) of the cartridge 20 to restrict movement of the cartridge 20 in the X-axis direction and the Y-axis direction in the mounting state. The third engaged structure 624 is disposed on the apparatus front wall portion 62 in the vicinity of the liquid introducing needle 622. In the Y-axis direction (second direction), the third engaged structure 624 includes a first engaged wall portion 626 located between the liquid introducing needle 622 and the first engaged portion 628, and a second engaged wall portion 627 that sandwiches the liquid introducing needle 622 and is located on a side opposite to the first engaged wall portion 626. The first engaged wall portion 626 and the second engaged wall portion 627 are both plate-shaped walls that extend from the apparatus front wall portion 62 in the positive Z-axis direction. The first engaged wall portion 626 restricts movement of the cartridge 20 in the positive Y-axis direction and the X-axis direction in the mounting state. The second engaged wall portion 627 restricts movement of the cartridge 20 in the negative Y-axis direction and the X-axis direction in the mounting state.

A second engaged portion 642 is a member used for engaging with a corresponding member (second engagement portion) of the cartridge 20. This engagement restricts movement of the cartridge 20 (more specifically, a portion of the cartridge 20 on the negative Y-axis direction side) in the demounting direction in the mounting state. The second engaged portion 642 is a groove portion (cut out) formed in the first side wall portion 64. The shape of the second engaged portion 642 is not limited hereto and may be any shape that achieves engagement with a corresponding member of the cartridge 20. For example, the second engaged portion 642 may be a through hole formed in the apparatus front wall portion 62.

The electrode portion 644 includes a plurality of holder-side terminals 645. The electrode portion 644 is provided on the first side wall portion 64. Nine holder-side terminals 645 are provided in this embodiment. The number of holder-side terminals 645 is not limited to nine and may be more or less than nine. The holder-side terminals 645 are electronically connected to the control unit 38 (FIG. 1). Some of the holder-side terminals 645 are located inside the cartridge storage chamber 69. Each holder-side terminal 645 is a plate-shaped metal member configured to elastically deform in at least the Y-axis direction. In the mounting state, each holder-side terminal 645 makes contact with a corresponding member (terminal) of the cartridge 20 to electronically connect thereto. Further, in the mounting state, each holder-side terminal 645 elastically deforms in the negative Y-axis direction, to thereby bias the cartridge 20 in the positive Y-axis direction.

As illustrated in FIG. 3, in the Y-axis direction (second direction), a center point between an inner surface of the first side wall portion 64 and an inner surface of the second side wall portion 65 is a center portion CPa, a side closer to the first side wall portion 64 from the center portion CPa is a one side RA, and a side closer to the second side wall portion 65 from the center portion CPa is an other side RB. In this case, the portions of the holder unit 61 have the following positional relationship to one another. That is, the liquid injecting needle 622, the third engaged structure 624, the electrode portion 644 and the second engaged portion 642 are located on the one side RA, and the first engaged portion 628 is located on the other side RB.

A-3. Configuration of Cartridge 20

Figure 4:
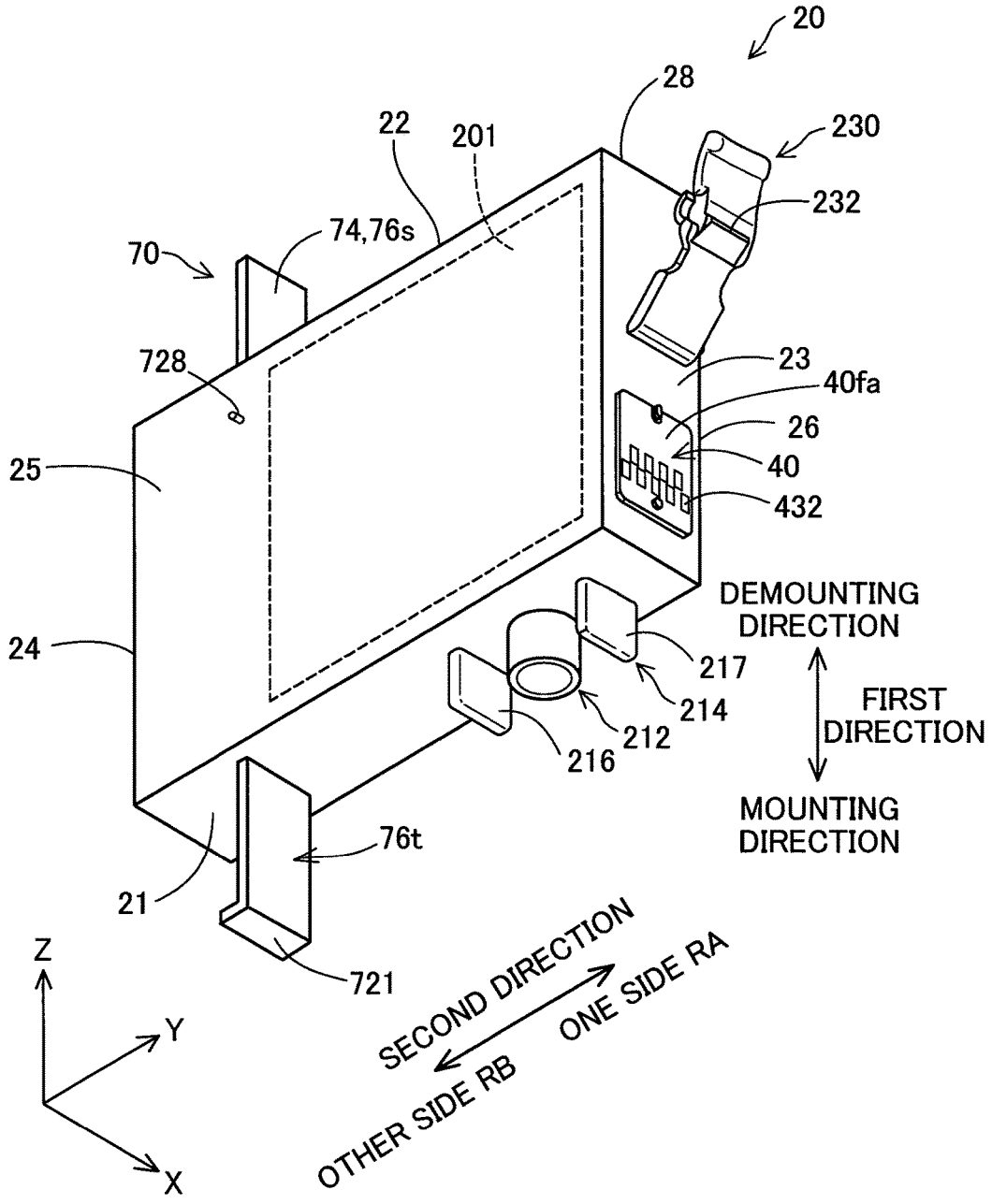
FIG. 4 is a perspective view for illustrating a cartridge.
Figure 5:
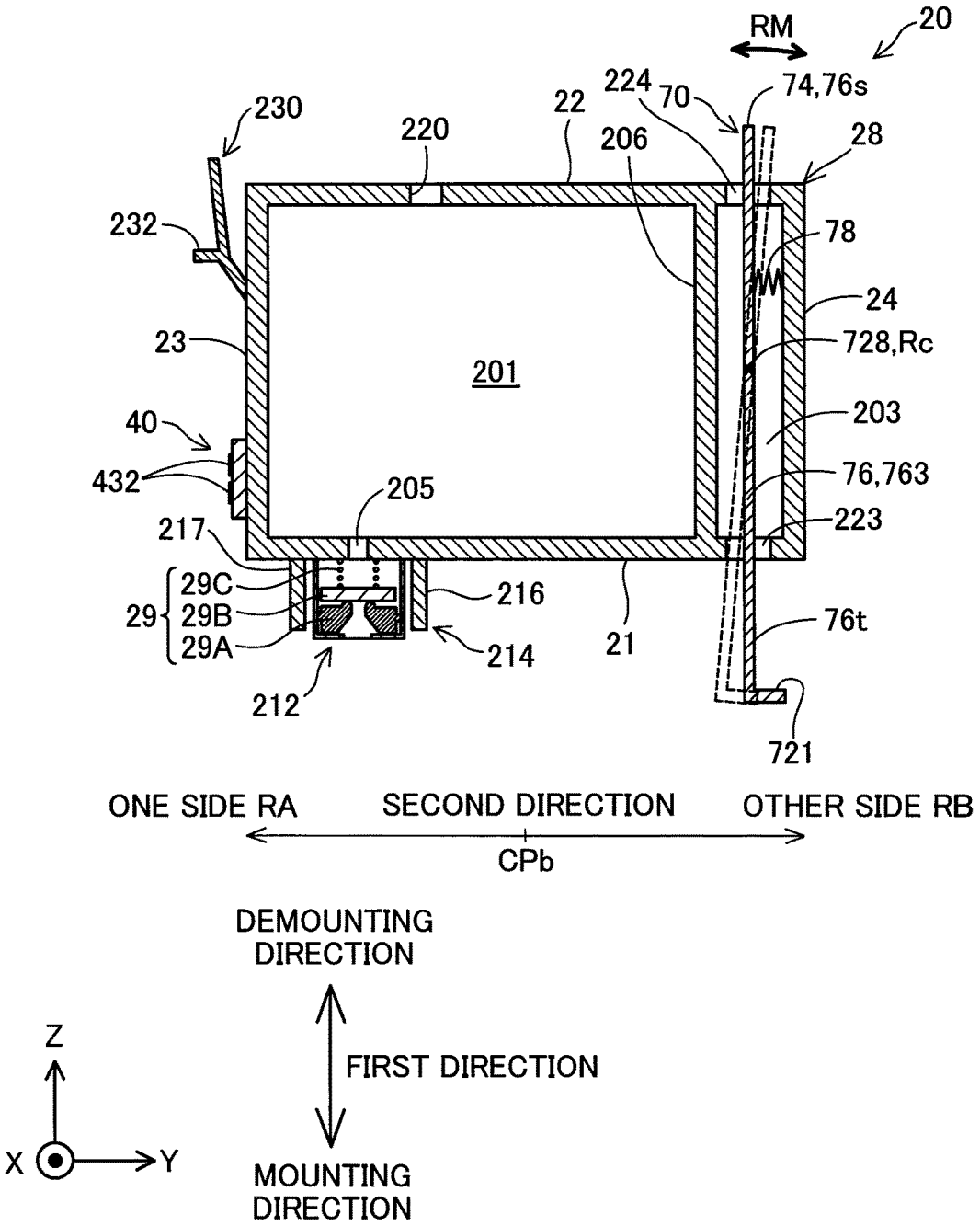
FIG. 5 is a cross-sectional view for illustrating the cartridge.
Figure 6:
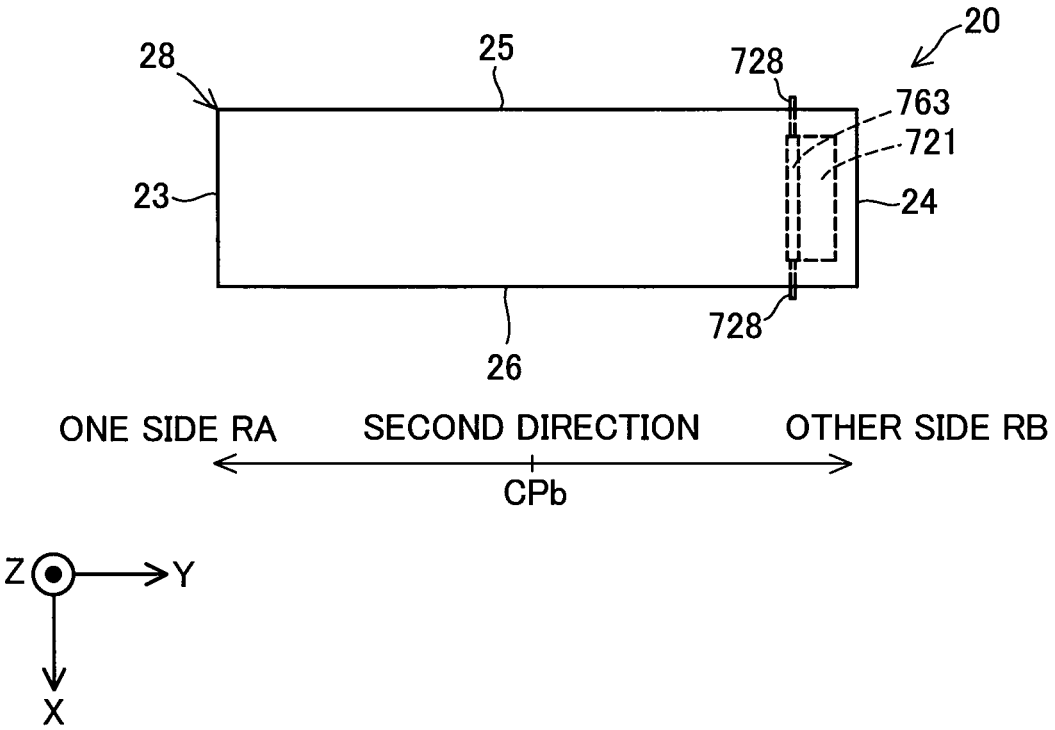
FIG. 6 is a diagram for describing the cartridge.

FIG. 4 is a perspective view for illustrating the cartridge 20. FIG. 5 is a cross-sectional view for illustrating the cartridge 20. FIG. 6 is a view for explaining the cartridge 20. XYZ-axes in the mounting state are shown in FIGS. 4 and 5. XYZ-axes in the mounting state are also shown as necessary in other figures for explaining other cartridges 20. FIG. 6 is a schematic view for illustrating the cartridge 20 when viewed from the demounting direction side.

The cartridge 20 includes a liquid storage portion 201 (FIG. 4) and an engagement structure arrangement portion 203 (FIG. 5). The liquid storage portion 201 and the engagement structure arrangement portion 203 are both partly defined the outer shell 28. The liquid storage portion 201 stores ink to be supplied to the printer 10. The engagement structure arrangement portion 203 is used for arranging a first engagement structure 70 to be described later. The liquid storage portion 201 and the engagement structure arrangement portion 203 are divided by a dividing wall 206 of the cartridge 20.

The cartridge 20 further includes the outer shell 28, a liquid supply port 212, a circuit substrate 40, and the first engagement structure 70, a second engagement structure 230 and a third engagement structure 214 as engagement structures.

The outer shell 28 forms an outer surface of the cartridge 20. The outer shell 28 is the body of the cartridge 20 and defines the space therein that includes the liquid storage portion 201. The outer shell 28 forms at least a part of the outer wall portion of the cartridge 20. The outer shell 28 is made of a synthetic resin such as polypropylene (PP). The outer shell 28 has a substantially triangular prism shape or a substantially cuboid shape. The outer shell 28 may be partly made of a resin film.

The outer shell 28 (FIG. 4) includes a first wall portion 21, a second wall portion 22, a third wall portion 23, a fourth wall portion 24, a fifth wall portion 25 and a sixth wall portion 26. The first to sixth wall portions 21 to 26 have outer surfaces that are substantially flat. The phrase "substantially flat" includes both a case in which the entire surface is completely flat and a case in which the surface is partly uneven. In other words, this includes a case in which, even if the surface is partly uneven, the surface can be recognized as a surface or a wall that forms the outer shell 28 of the cartridge 20. An outer shape of each of the first to sixth wall portions 21 to 26 as seen in plan view is substantially rectangular.

As illustrated in FIG. 5, in the cartridge 20, a center point between the outer front surface of the third wall portion 23 and the outer front surface of the fourth wall portion 24 is a center portion CPb in the second direction, the side of the third wall portion 23 with respect to the center portion CPb is a one side RA, and a side of the fourth wall portion 24 with respect to the center portion CPb is an other side RB.

The first wall portion 21 forms a horizontal bottom surface in the mounting state. The first wall portion 21 faces a direction that includes a mounting direction (negative Z-axis direction) component. In this embodiment, the first wall portion 21 faces the mounting direction. The phrase "wall portion (element) faces a direction" refers to the orientation of a normal vector Be in an outer front surface of the wall portion (element). In other words, in this embodiment, a normal vector of the outer surface of the first wall portion 21 is oriented in the mounting direction. Here, the first wall portion 21 is also referred to as "tip side portion 21." The first wall portion (tip side portion) 21 can also be referred to as a portion of the outer shell 28 located closer to the mounting direction. The first wall portion (tip side portion) 21 is also a portion that faces the apparatus front wall portion 62 provided with the liquid injecting needle 622. The first wall portion 21 is not limited to facing the mounting direction and may face a direction having a mounting direction component.

The second wall portion 22 forms a horizontal top surface in the mounting state. The second wall portion 22 opposes the first wall portion 21. The second wall portion 22 is a portion that faces a direction including a demounting direction (positive Z-axis direction) component. In this embodiment, the second wall portion 22 faces the demounting direction. Herein, "a case in which two elements oppose each other" includes two cases in which another element is located between the two elements and a case in which no other element is located between the two elements. An air induction port 220 is formed in the second wall portion 22. The air induction port 220 introduces air to the liquid storage portion 201 in accordance with consumption of the ink in the liquid storage portion 201. In addition, the second wall portion 22 or another component of the cartridge 20 may be provided with a liquid inlet for injecting the ink into the liquid storage portion 201.

The third wall portion 23 forms a front surface in the mounting state. The third wall portion 23 intersects with the first wall portion 21 and the second wall portion 22. An outer surface of the third wall portion 23 is a surface (XZ plane) parallel to both the X-axis direction and the Z-axis direction and perpendicular to the Y-axis direction. The third wall portion 23 is located on one side (negative Y-axis direction side) in the second direction (Y-axis direction). Herein, when two elements (for example, wall portions or surfaces) "intersect with each other," this refers to any one of the following states. That is, a state in which the two elements actually intersect with each other, a state in which one element is extended and intersects with the other element, and a state in which both elements are extended and intersect with each other.

The fourth wall portion 24 forms a back surface in the mounting state. The fourth wall portion 24 intersects with the first wall portion 21 and the second wall portion 22. The fourth wall portion 24 opposes the third wall portion 23. An outer surface of the fourth wall portion 24 is a surface (YZ plane) parallel to both the X-axis direction and the Z-axis direction and perpendicular to the Y-axis direction. The fourth wall portion 24 is located on an other side (positive Y-axis direction side) in the second direction (Y-axis direction).

The fifth wall portion 25 forms a left-side surface in the mounting state. The sixth wall portion 26 forms a right-side surface in the mounting state. The fifth wall portion 25 and the sixth wall portion 26 each intersect with the first to fourth wall portions 21 to 24. Outer surfaces of the fifth wall portion 25 and the sixth wall portion 26 are surfaces (YZ plane) parallel to both the Y-axis direction and the Z-axis direction and perpendicular to the X-axis direction. The fifth wall portion 25 and the sixth wall portion 26 oppose each other. The fifth wall portion 25 is located on one side (negative X-axis direction side) in a third direction (X-axis direction) orthogonal to the first direction (Z-axis direction) and the second direction (Y-axis direction). The sixth wall portion 26 is located on an other side (positive X-axis direction side) in the third direction.

The liquid supply port 212 (FIG. 4) can connect with the liquid injecting needle 622 (FIG. 3). The liquid supply port 212 (FIG. 5) communicates with the liquid storage portion 201 via a communication hole 205 formed in the first wall portion 21. The liquid supply port 212 is arranged on the first wall portion 21 that forms the tip side portion of the outer shell 28. The liquid supply port 212 is also located on the one side RA in the second direction. The liquid supply port 212 is a tubular member that protrudes from the first wall portion 21 in the mounting direction. A tip of the liquid supply port 212 is open. The liquid supply port 212 distributes the ink stored in the liquid storage portion 201 to the outside (for example, the liquid injecting needle 622) via the tip opening. In the mounting state, the liquid supply port 212 is connected to the liquid injecting needle 622 by inserting the liquid injecting needle 622 into the tubular liquid supply port 212. With this connection, it is possible to distribute the ink to the liquid injecting needle 622 from the liquid supply port 212.

A valve mechanism 29 is disposed inside the liquid supply port 212. This valve mechanism 29 opens and closes a flow path inside the liquid supply port 212. The valve mechanism 29 includes a sealing portion (valve seat) 29A, a valve element 29B and a biasing member 29C in order from the tip of the liquid supply port 212. The sealing portion 29A is a substantially annular member. The sealing potion 29A is configured of an elastic body such as rubber or an elastomer. The sealing portion 29A is press-fitted inside a liquid supply port 212. The valve element 29B is a substantially annular member. The valve element 29B covers a hole (valve hole) formed in the sealing portion 29A in a state before the cartridge 20 is mounted onto the holder unit 61 (pre-mounting state). The biasing member 29C is a compression coil spring. The biasing member 29C biases the valve element 29B in a direction toward the sealing portion 29A. In the mounting state of the cartridge 20, the liquid injecting needle 622 (FIG. 3) presses the valve element 29B toward a direction away from the sealing portion 29A, to thereby separate the valve element 29B from the sealing portion 29A. With this configuration, the valve mechanism 29 opens.

The circuit board 40 (FIG. 4) is disposed on the third wall portion 23 located on the one side RA in the second direction (Y-axis direction). A normal vector of a front surface 40*fa* of the circuit board 40 is oriented in the negative Y-axis direction. A plurality of unit-side terminals 432 are provided on the front surface 40*fa*. The unit-side terminals 432 are disposed on the one side RA in the second direction. Nine unit-side terminals 432 are provided to correspond to the number of holder-side terminals 645 (FIG. 3). Each unit-side terminal 432 has a substantially rectangular outer shape. A center portion of the substantially rectangular-shaped unit-side terminal 432 makes contact with a corresponding holder-side terminal 645, to thereby allow electronic connection between the unit-side terminal 432 and the holder-side terminal 645. An electronic device (not shown) such as a storage device is provided on a rear surface of the circuit board 40. This electronic device is connected to the unit-side terminals 432 through wiring. For example, the storage device stores information on the ink (amount of ink remaining, color of ink) in the cartridge 20. In the mounting state of the cartridge 20, signals are sent/received between the storage device and the control unit 38 (FIG. 1).

The first engaged structure 70 has a structure for engaging with the holder unit 61, to thereby restrict movement of the cartridge 20 in the demounting direction (negative Z-axis direction) in the mounting state. The first engaged structure 70 (FIG. 5) includes a body portion 76 and a biasing member 78.

The body portion 76 is a plate-shaped member. The body portion 76 is a member formed of a synthetic resin such as polypropylene (PP) or a metal. A part of the body portion 76 is housed inside the engagement structure arrangement portion 203. A one end side portion 76*t* of the body portion 76 protrudes outward (mounting direction) from the first wall portion 21 (more specifically, the opening 223 formed in the first wall portion 21). An other end side portion 76*s* of the body portion 76 protrudes outward (demounting direction) from the second wall portion 22 (more specifically, an opening 224 formed in the second wall portion 22). The one end side portion 76*t* is bent partway to form a first engagement portion 721. In other words, one end of the body portion 76 forms the engagement portion 721. The other end side portion 76*s* forms an operation portion 74 that is operated by the user.

The first engagement portion 721 can restrict movement of the cartridge 20 in the demounting direction by engaging with the first engaged portion 628 (FIG. 3) of the holder unit 61. The first engagement portion 721 has a flat plate shape. The first engagement portion 721 is disposed on the mounting direction side (negative Z-axis direction side) of the outer shell 28. As illustrated in FIG. 6, the first engagement portion 721 is disposed at a position that overlaps with the outer shell 28 in at least a free state of the biasing member 78 when the cartridge 20 is viewed from the demounting direction side (negative Z-axis direction). The first engagement portion 721 may be disposed at a position that overlaps with the outer shell 28 regardless of displacement when the cartridge 20 is viewed from the demounting direction side (negative Z-axis direction side). In addition, in the mounting state of the cartridge 20, the first engagement portion 721 is disposed on the other side RB in the second direction.

A portion of the body portion 76 that connects the first engagement portion 721 and the operation portion 74 to each other is also referred to as "connecting portion 763" (FIG. 5). Fulcrum forming portions 728 are disposed in the connecting portion 763. As illustrated in FIG. 6, the fulcrum forming portions 728 are columnar rod members that extend from both side surfaces of the connecting portion 763 in the X-axis direction. End portions of the fulcrum forming portion 728 are rotatably supported by the fifth wall portion 25 and the sixth wall portion 26. With this configuration, the connecting portion 763 forms a fulcrum Rc about which the first engagement portion 721 and the operation portion 74 rotatably move. The first engagement portion 721 and the operation portion 74 can rotate about the fulcrum Rc in a rotation direction RM along a plane parallel to the Z-axis direction (first direction) and the Y-axis direction (second direction).

The biasing member 78 (FIG. 5) is a compression coil spring. One end of the biasing member 78 comes into contact with the body portion 76, and an other end of the biasing member 78 comes into contact with the fourth wall portion 24. The biasing member 78 biases a portion of the body portion 76 located between the fulcrum Rc and the operation portion 74. The biasing member 78 biases the body portion 76 in the second direction from the fourth wall portion 24 toward the third wall portion 23.

The operation portion 74 is a member used for operating engagement between the first engagement portion 721 and the first engaged portion 628 of the holder unit 61. More specifically, the operation portion 74 displaces the first engagement portion 721 to operate engagement and release of engagement between the first engagement portion 721 and the first engaged portion 628. As indicated by the broken line in FIG. 5, the user displaces the operation portion 74 toward a direction from the fourth wall portion 24 to the third wall portion 23 against biasing force of the biasing member 78. With this configuration, the first engagement portion 721 rotates and displaces toward the third wall portion 23 about the fulcrum Rc. The operation portion 74 protrudes outward from a portion of the outer shell 28 different to the tip end portion 21 (first wall portion 21). In this embodiment, the operation portion 74 protrudes outward from the second wall portion 22 (a portion facing a direction including a demounting direction component) in the demounting direction (positive Z-axis direction). The protruding direction of the operation portion 74 is not limited to the demounting direction and may be a direction including a demounting direction component. For example, the operation portion 74 may protrude outward in a direction including a demounting direction (positive Z axis direction) and a positive Y-axis direction component.

The second engagement structure 230 has a structure for restricting movement of the cartridge in the mounting state in the demounting direction (positive Z axis direction) by engaging with the holder unit 61. The second engagement structure 230 is provided on the third wall portion 23. The second engagement structure 230 has elasticity and can elastically deform in the Y-axis direction. The second engagement structure 230 is made of a synthetic resin such as polypropylene (PP). The second engagement structure 230 includes a second engagement portion 232 that can engage with the second engaged portion 642 (FIG. 3) of the holder unit 61 to restrict movement of the cartridge 20 in the demounting direction (positive Z-axis direction).

In the mounting state, the third engagement structure 214 has a structure for restricting movement of the cartridge 20 along a plane (XY plane) orthogonal to the mounting direction (negative Z-axis direction) by cooperating with the third engaged structure 624 of the holder unit 61. The third engagement structure 214 is made of a synthetic resin such as polypropylene (PP). The third engagement structure 214 includes a third engagement portion 216 and a fourth engagement portion. The third engagement portion 216 and the fourth engagement portion 217 are plate-shaped members that protrude outward from the first wall portion 21. The third engagement portion 216 and the fourth engagement portion 217 are disposed on the first wall portion 21 which is a tip end portion. The third engagement portion 216 and the fourth engagement portion 217 are arranged in the second direction (Y-axis direction) so as to sandwich the liquid supply port 212. The first restricting portion 215 is disposed on the first wall portion 21 as the tip end portion between the liquid supply port 212 and the first engagement portion 721 in the second direction. The fourth engagement portion 217 is located on the first wall portion 21 closer to the one side (positive Y-axis direction side) than the liquid supply port 212 in the second direction. In the mounting state of the cartridge 20, the third engagement portion 216 and the fourth engagement portion 217 are arranged between the first engaged wall portion 626 and the second engaged wall portion 627 (FIG. 2). In the mounting state, the third engagement portion 216 cooperates with the first engaged wall portion 626 to restrict movement of the cartridge 20 in the positive Y-axis direction and the X-axis direction. In the mounting state, the fourth engagement portion 217 cooperates with the second engaged wall portion 627 to restrict movement of the cartridge 20 in the negative Y-axis direction and the X-axis direction.

A-4. Aspects of Mounting Cartridge 20 onto Holder Unit 61

Figure 7:
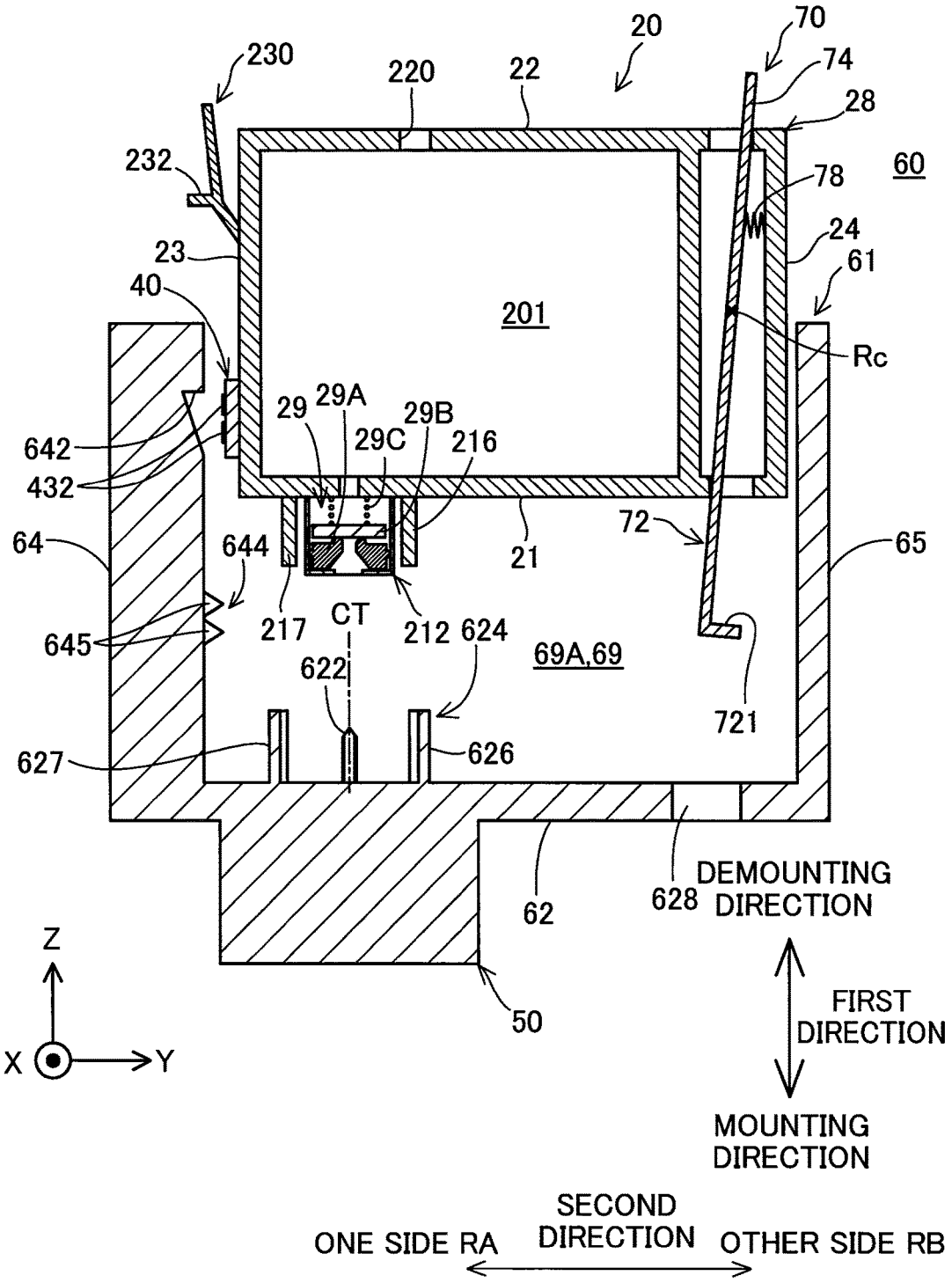
FIG. 7 is a diagram for illustrating a process of mounting the cartridge onto a holder unit.

FIG. 7 is a diagram for illustrating a process of mounting the cartridge 20 onto the holder unit 61. When the cartridge 20 is to be mounted onto the holder unit 61, the user displaces the operation portion 74 toward the fourth wall portion 24, to thereby displace the first engagement portion 721 by making the first engagement portion 721 rotate about the fulcrum Rc toward the third wall portion 23. In this state, the cartridge 20 is moved in the mounting direction toward the cartridge storage chamber 69.

Figure 8:
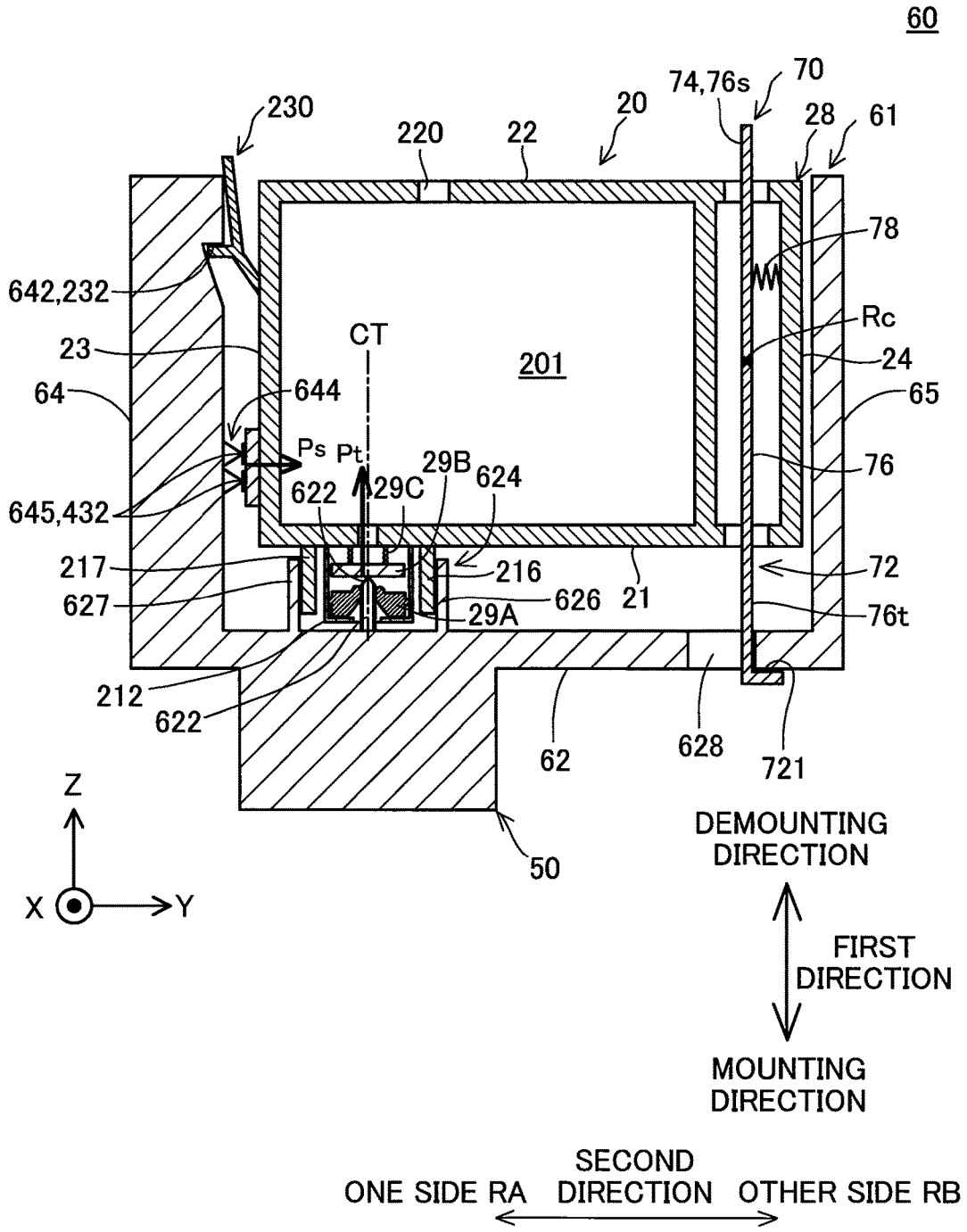
FIG. 8 is a diagram for illustrating a mounting state of the cartridge.

FIG. 8 is a diagram for illustrating a mounting state of the cartridge 20. The cartridge 20 is further moved from the state illustrated in FIG. 7 in the mounting direction, to thereby connect the liquid introducing needle 622 to the liquid supply port 212 and make the second engagement portion 232 engage with the second engaged portion 642. In addition, the unit-side terminal 432 makes contact with the holder-side terminal 645. Further, the body portion 76 (more specifically, the one end side portion 76*t*) of the first engaged structure 70 is inserted into the first engaged portion 628. Then, the user removes his/her hand from the operation portion 74 to displace the first engagement portion 721 toward the positive Y-axis direction by the biasing force of the biasing member 78. With this configuration, the first engaged portion 628 and the first engagement portion 721 engage with each other. When the cartridge 20 is to be demounted from the holder unit 61, the second engagement structure 230 is displaced toward the third wall portion 23 and the second engagement portion 232 and the second engaged portion 642 engage with each other. Further, the operation portion 74 is displaced toward the fourth wall portion 24, to thereby displace the first engagement portion 721 toward the third wall portion 23 and release engagement between the first engagement portion 721 and the second engaged portion 642. Then, the user moves the cartridge 20 in the demounting direction to demount the cartridge 20 from the holder unit 61.

In the mounting state of the cartridge 20, the cartridge 20 is subject to external forces Pt and Ps from the holder unit 61. The external force Pt is a force applied to the valve element 29B of the cartridge 20 by the liquid introducing needle 622. The external force Pt is oriented in the demounting direction (positive Z-axis direction). The external force Ps is a force applied to the unit-side terminal 432 of the cartridge 20 by the holder-side terminal 645. The external force Ps is oriented in a direction (positive Y-axis direction) from the one side RA to the other side RB in the second direction.

The first engagement portion 721 engages with the first engaged portion 628 (a part of the apparatus front wall portion 62 that forms an opening), to thereby restrict movement of the cartridge 20 in the demounting direction. Movement of the cartridge 20 in the demounting direction is also restricted by the second engagement portion 232 engaging with the second engaged portion 642. In addition, the third engagement portion 216 engages with the first engaged wall portion 626, to thereby restrict movement of the cartridge 20 from the one side RA to the other side RB and movement of the cartridge 20 in the X-axis direction. The fourth engagement portion 217 engages with the second engaged wall portion 627, to thereby restrict movement of the cartridge 20 from the other side RB to the one side RA and movement of the cartridge 20 in the X-axis direction.

According to the first embodiment, as illustrated in FIG. 6, when the cartridge 20 is viewed from the demounting direction side, the first engagement portion 721 is disposed at a position that overlaps with the outer shell 28. With this configuration, the possibility of the cartridge 20 inclining from the correct mounting posture in the mounting state can be reduced, compared to a case in which the first engagement portion 721 is disposed at a position (for example, the fourth wall portion 24) that does not overlap with the outer shell 28. In addition, because the first engagement portion 721 is disposed closer to the mounting direction side than the outer shell 28, the cartridge 20 can be prevented from increasing in size in a direction orthogonal to the mounting direction.

According to the first embodiment, as illustrated in FIG. 5, the liquid supply port 212 is disposed on the one side RA in the second direction and the first engagement portion 721 is disposed on the other side RB in the second direction. With this configuration, the first engagement portion 721 and the first engaged portion 628 can be engaged with each other on the other side RB in the second direction while the liquid supply port 212 and the liquid introducing needle 622 can be connected to each other on the one side RA in the second direction. In this embodiment, the second engagement portion 232 is disposed on the one side RA, and the first engagement portion 721 is disposed on the other side RB. Therefore, movement of the cartridge 20 in the demounting direction can be restricted from both sides in the second direction. As a result, the possibility of the cartridge 20 inclining can be further reduced.

In the second direction, the liquid supply port 212 is preferably disposed closer to the third wall portion 23 from the central portion CPb and the first engagement portion 721 is preferably disposed closer to the fourth wall portion 24 from the central portion CPb. With this configuration, the liquid supply port 212 and the first engagement portion 721 can further separate from each other, and hence, even when ink leaks from the liquid supply port 212, the possibility of the leaked ink adhering to the first engagement portion 721 can be reduced.

According to the first embodiment, as illustrated in FIG. 5, the first engaged structure 70 includes an operation portion 74. With this configuration, the user can use the operation portion 74 to easily engage the first engagement portion 721 and the first engaged portion 628 with each other. In addition, as illustrated in FIG. 5, the operation portion 74 protrudes outward from a portion of the outer shell 28 different to a portion located on the mounting direction side. With this configuration, the user can easily operate the operation portion 74. In particular, in this embodiment, the operation portion 74 protrudes outward from the second wall portion 22 located on the demounting direction side toward the demounting direction side. With this configuration, the user can even more easily operate the operation portion 74.

According to the first embodiment, as illustrated in FIG. 5, the first engaged structure 70 includes the connecting portion 763 that forms a fulcrum Rc about which the first engagement portion 721 and the operation portion 74 rotatably move. With this configuration, the operation portion 74 and the first engagement portion 721 can be displaced about the fulcrum Rc.

A-5. Modification Example of First Engaged Structure 70A

The first engaged structure 70 used in the cartridge 20 is not limited to the configuration according to the first embodiment and may have another configuration, provided that the first engaged structure 70 can engage with the first engaged portion 628. An example of a first engaged structure 70A as a modification example is described below.

Figure 9:
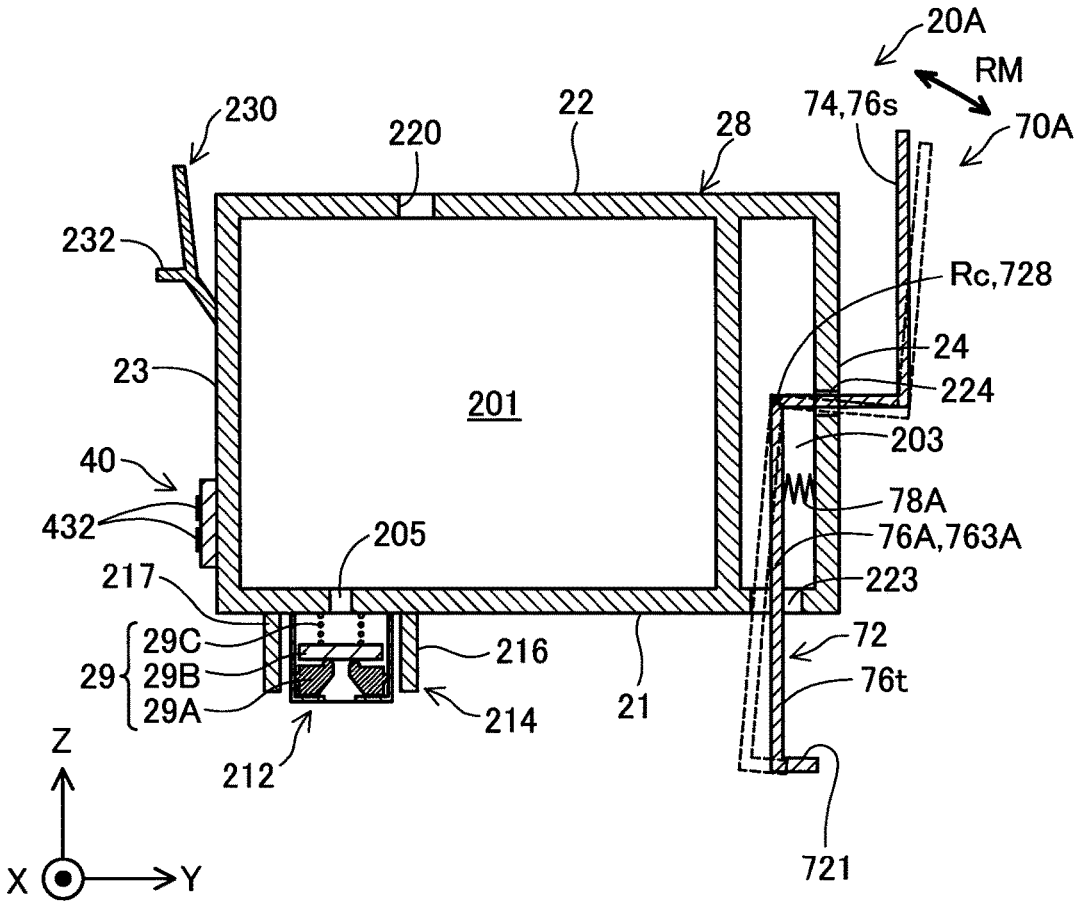
FIG. 9 is a diagram for explaining a first engagement structure as a modification example.

FIG. 9 is a diagram for explaining a first engaged structure 70A according to a modification example. The first engaged structure 70A and the first engaged structure 70 (FIG. 5) according to the first embodiment differ from each other in terms of the configuration of a connecting portion 763A, the direction in which the operation portion 74 protrudes outward, and the configuration of the biasing member 78A. Other configurations are the same as those of the first engaged structure 70, and hence like components are denoted by like reference symbols and a description thereof is omitted. In addition, the outer shell 28 of the cartridge 20A used in the first engaged structure 70A has an opening 224 formed in the fourth wall portion 24. Other configurations are the same as those of the cartridge 20 according to the first embodiment, and hence like components are denoted by like reference symbols and a description thereof is omitted.

The connecting portion 763A of the first engaged structure 70A has a plate-like shape that is bent partway at 90°. A fulcrum forming portion 728 is disposed at this bent portion to form a fulcrum Rc. The other end side portion 76*s* of the body portion 76A protrudes outward from the opening 224 of the fourth wall portion 24. The biasing member 78A is a tension coil spring. The biasing member 78A biases the body portion 76A in the second direction (Y-axis direction) in a direction extending from the third wall portion 23 to the fourth wall portion 24. The user displaces the operation portion 74 in the direction that extends from the third wall portion 23 to the fourth wall portion 24 against biasing force of the biasing member 78A. With this configuration, the first engagement portion 721 rotates is displaced toward the third wall portion 23 about the fulcrum Rc (is displaced to the state indicated by the broken line). Under the state in which the first engagement portion 721 is displaced, the user removes his/her hand from the operation portion 74 after the one end side portion 76*t* has been inserted into the first engaged portion 628 that forms an opening. As a result, the first engagement portion 721 is displaced toward the fourth wall portion 24 by the biasing force of the biasing member 78A. With this configuration, the first engaged portion 628 and the first engagement portion 721 engage with each other.

B. Second Embodiment

B-1. Configuration of Liquid Ejection System

Figure 10:
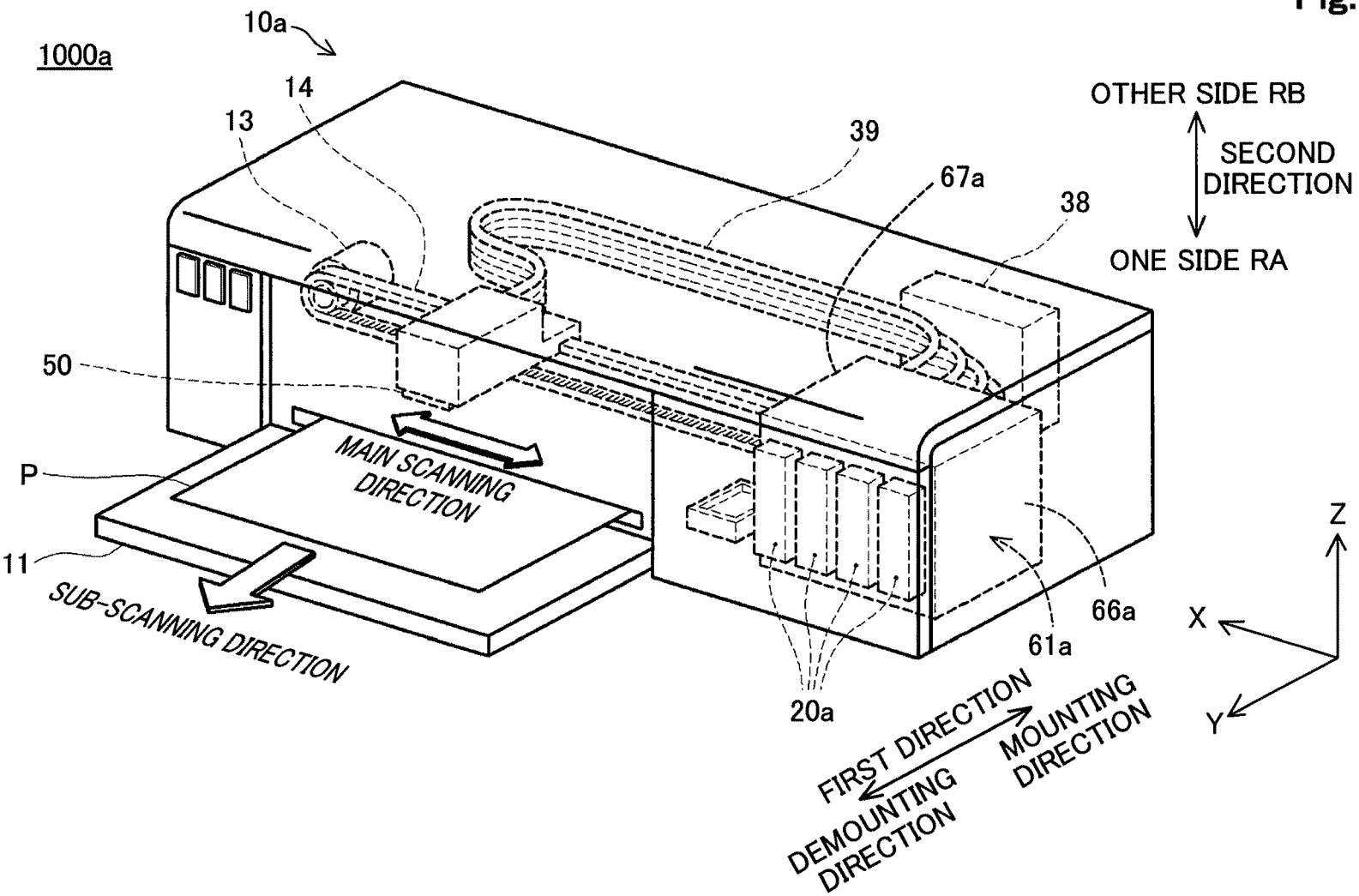
FIG. 10 is a perspective view for illustrating a configuration of a liquid ejection system according to a second embodiment.

FIG. 10 is a perspective view for illustrating the configuration of a liquid ejection system 1000*a* according to a second embodiment of the present invention. The liquid ejection system 1000*a* and the liquid ejection system 1000 (FIG. 1) differ from each other in that the liquid ejection system 1000*a* is an off-carriage printer 10*a* and a cartridge 20*a* has a different configuration. In addition, the mounting direction and the demounting direction of the cartridge 20*a* is a horizontal direction and, in this embodiment, is a direction along the Y-axis direction. Other configurations are the same as those according to the first embodiment, and hence like components are denoted by like reference symbols and a description thereof is omitted. Although not shown in FIG. 10, the printer 10*a* includes the flexible cable 37 (FIG. 1) as in the first embodiment.

The printer 10*a* includes a tube 39 for distributing ink stored in the cartridge 20*a* to the head unit 50. The ink is supplied to the head unit 50 by intaking the ink in the cartridge 20*a* using a pumping mechanism (not shown) of the printer 10*a*. The holder unit 61*a* is configured such that four cartridges 20*a* can be mounted thereon. In the second embodiment, the first direction is the Y-axis direction, and the mounting direction of the cartridge 20*a* is the negative Y-axis direction, and the demounting direction of the cartridge 20*a* is the positive Y-axis direction. In addition, in the second embodiment, the second direction is the Z-axis direction, the one side RA is on the negative Z-axis direction side, and the other side RB is on the positive Z-axis direction side.

Figure 11:
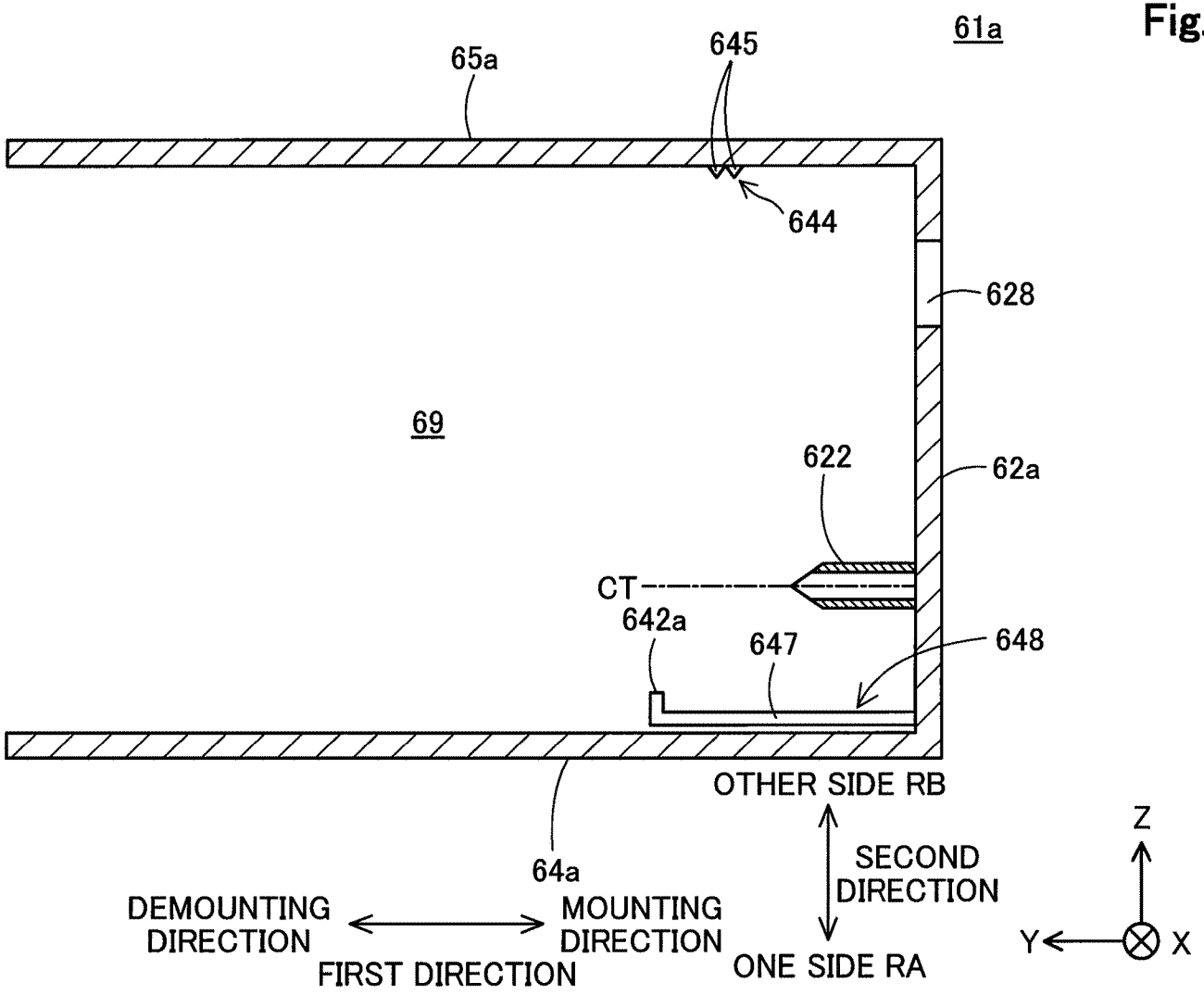
FIG. 11 is a diagram for explaining the holder unit.

FIG. 11 is a diagram for explaining the holder unit 61*a*. The holder unit 61*a* includes five wall portions 62*a*, 64*a*, 65*a*, 66*a* and 67*a* (FIGS. 10 and 11). These five wall portions 62*a*, 64*a*, 65*a*, 66*a* and 67*a* correspond to the five wall portions 62, 64, 65, 66 and 67 according to the first embodiment, respectively. In other words, the wall portion 62*a* is located on the mounting direction side. In the second embodiment, the wall portion 64*a* forms a bottom wall of the holder unit 61*a*. The four wall portions 64*a*, 65*a*, 66*a* and 67*a* extend from a periphery edge portion of the wall portion 62*a* in the positive Y-axis direction (demounting direction). The five wall portions 62*a*, 64*a*, 65*a*, 66*a* and 67*a* form the concave cartridge storage chamber 69. The cartridge storage chamber 69 is divided into a plurality of slots (mounting spaces) that can each receive one cartridges 20*a*.

The wall portion 62*a* is also referred to as "apparatus front wall portion 62*a*," the wall portion 64*a* is also referred to as "first side wall portion 64*a*," the wall portion 65*a* is also referred to as "second side wall portion 65*a*," the wall portion 66*a* is also referred to as "third side wall portion 66*a*," and the wall portion 67*a* is also referred to as "fourth side wall portion 67*a*."

The holder unit 61*a* includes the liquid introducing needle 622, the first engaged portion 628, a second engaged structure 648 including a second engaged portion 642*a* and the electrode portion 644 for each slot. A protruding direction of the liquid introducing needle 622 is a positive Y-axis direction from the wall portion 62*a*, which is different from the first embodiment. The central axis CT of the liquid introducing needle 622 extends in the Y-axis direction. In other words, in the second embodiment, the Y-axis direction is the first direction. Similar to the first embodiment, the first engaged portion 628 is an opening formed in the apparatus front wall portion 62*a*. The electrode portion 644 is provided on the second side wall portion 65*a* that forms a top wall. In the second embodiment, a biasing member (for example, a coil spring) may be disposed in the vicinity of the liquid introducing needle 622 for biasing the cartridge 20*a* toward the demounting direction. With such a configuration, the possibility of engagement between the second engaged portion 642*a* and a second engagement portion of a cartridge 20*a* to be described later unintentionally releasing can be reduced.

The second engaged structure 648 is made of a metal plate. The second engaged structure 648 includes a body portion 647 that extends from the apparatus front wall portion 62*a* toward the demounting direction side and a second engaged portion 642*a* disposed on a tip side (positive Y-axis direction side) of the body portion 647. The body portion 647 is configured such that a tip portion thereof provided with the second engaged portion 642*a* can be displaced in the X-axis direction with a rear end portion on the side of the apparatus front wall portion 62*a* as a fulcrum. More specifically, the body portion 647 is configured such that the tip portion provided with the second engaged portion 642*a* can displace toward the negative X-axis direction side as a result of external force while being biased toward the positive X-axis direction side by a spring (not shown). The second engaged portion 642*a* is a protrusion that protrudes outward from the body portion 647 in the positive Z-axis direction. The second engaged portion 642*a* restricts movement of the cartridge 20*a* in the demounting direction by engaging with a corresponding member of the cartridge 20*a* (the second engagement portion).

The liquid introducing needle 622 and the second engaged portion 642*a* is located on the one side RA of the holder unit 61*a*. The first engaged portion 628 is located on the other side RB of the holder unit 61*a*.

Figure 12:
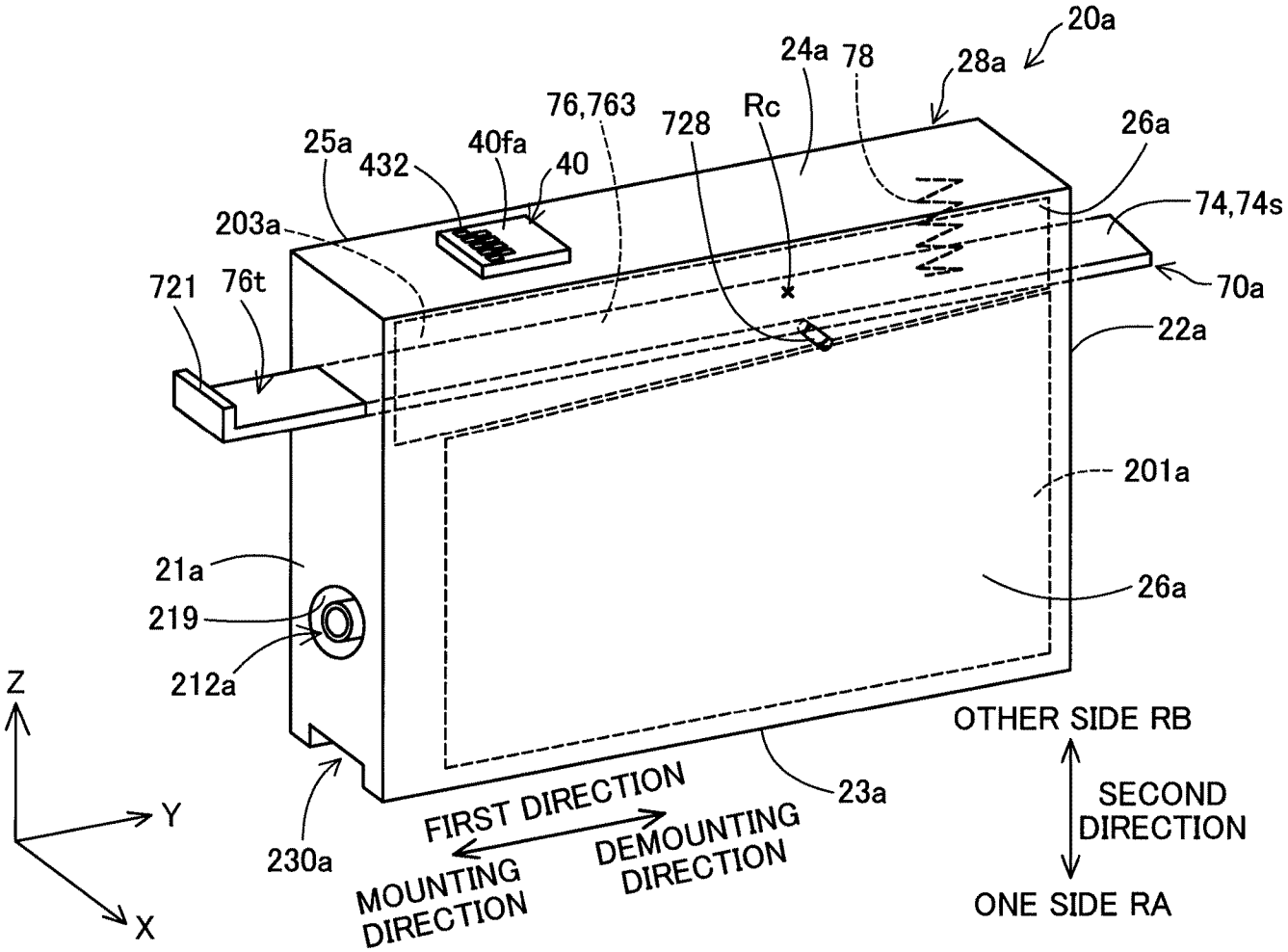
FIG. 12 is a perspective view for illustrating the cartridge.

FIG. 12 is a is a perspective view for illustrating the cartridge 20*a*. The cartridge 20*a* includes a liquid storage portion 201*a* and an engagement structure arrangement portion 203*a*. The liquid storage portion 201*a* is a bag member housed inside the outer shell 28*a*. The ink is filled into this bag member. The engagement structure arrangement portion 203*a* is defined by the later-described outer shell 28*a*. Similar to the first embodiment, the engagement structure arrangement portion 203*a* is used for arranging a first engaged structure 70*a* to be described later.

The cartridge 20*a* further includes the outer shell 28*a*, the liquid supply port 212*a*, the circuit board 40, the first engaged structure 70*a* as an engagement structure and a second engagement structure 230*a*.

An outer shell 28*a* forms an outer surface having a substantially quadrangular cylindrical shape or a substantially cuboid shape. As in the first embodiment, the outer shell 28*a* includes first to sixth wall portions 21*a* to 26*a*. The first to sixth wall portions 21*a* to 26*a* correspond to the first to sixth wall portions 21 to 26 (FIG. 4) according to the first embodiment, respectively. In other words, the first wall portion 21*a* forms a tip side portion of the cartridge 20*a*. In this embodiment, as in the first embodiment, the first wall portion 21*a* faces the mounting direction (negative Y-axis direction). The second wall portion 22*a* opposes the first wall portion 21*a* and is located on the demounting direction (positive Y-axis direction) side. The third wall portion 23*a* is located on the one side RA (negative Z-axis direction side) in the second direction. The fourth wall portion 24*a* opposes the third wall portion 23*a* and is located on the other side RB (positive Z-axis direction side) in the second direction. The fifth wall portion 25*a* and the sixth wall portion 26*a* form both side surfaces in the third direction (X-axis direction) orthogonal to the first direction and the second direction.

A supply unit arrangement port 219 used to arrange the liquid supply port 212*a* is formed in the first wall portion 21*a*. The supply unit arrangement port 219 is located on the one side RA.

The liquid supply port 212*a* can connect to the liquid injecting needle 622 (FIG. 11). The liquid supply port 212*a* communicates with the liquid storage portion 201*a*. The liquid supply port 212*a* is disposed in the supply unit arrangement port 219. As in the first embodiment, the valve mechanism 29 (FIG. 5) is provided inside the liquid supply port 212*a*.

The circuit board 40 is arranged on the fourth wall portion 24*a*. A normal vector of the front surface 40*fa* of the circuit board 40 is the positive Z-axis direction. A plurality of unit-side terminals 432 are provided on the front surface 40*fa* of the circuit board 40.

The first engaged structure 70*a* has a structure for restricting movement of the cartridge 20 in the mounting state in the demounting direction (negative Z-axis direction) by engaging with the holder unit 61. The first engaged structure 70*a* includes the body portion 76, the connecting portion 763 and the biasing member 78. The first engaged structure 70*a* and the first engaged structure 70 (FIG. 4) according to the first embodiment differ from each other in terms of the orientation of arrangement. The first engaged structure 70*a* is disposed so as to penetrate the first wall portion 21*a* and the second wall portion 22*a* that are substantially vertical in the mounting state. The one end side portion 76*t* of the body portion 76 protrudes outward (mounting direction) from the opening 223 formed in the first wall portion 21*a* (more specifically, the first wall portion 21*a*). The first engagement portion 721 is disposed on the mounting direction side of the outer shell 28*a*. The first engagement portion is disposed at a position that overlaps with the outer shell 28*a* when the cartridge 20*a* is viewed from the demounting direction side. One end portion of the biasing member 78 comes into contact with the body portion 76 and an other end portion of the biasing member 78 comes into contact with the fourth wall portion 24*a*. The biasing member 78 biases a portion of the body portion 76 located between the fulcrum Rc and the operation portion 74. The biasing member 78 biases the body portion 76 in the second direction in a direction that extends from the fourth wall portion 24*a* to the third wall portion 23*a*.

The second engagement structure 230*a* is a groove structure formed in the third wall portion 23*a*. The second engagement structure 230*a* includes a second engaged portion (not shown) that can restrict movement of the cartridge 20*a* in the demounting direction by engaging with the second engaged portion 642*a* (FIG. 11). The second engaged portion is formed by a wall portion that creates a groove structure. The second engagement structure 230*a* is described in detail later.

Figure 13:
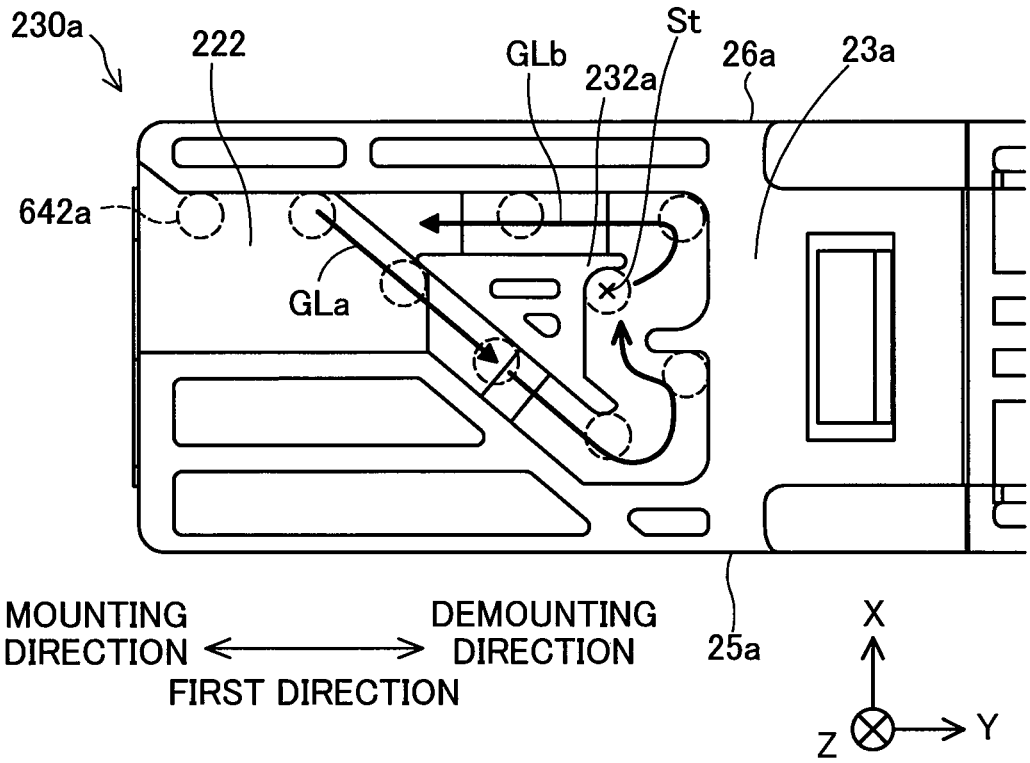
FIG. 13 is a diagram for illustrating a second engagement structure.

FIG. 13 is a diagram for illustrating a second engagement structure 230*a*. To facilitate understanding, FIG. 13 also illustrates the second engaged portion 642*a* of the second engaged structure 648. The second engagement structure 230*a* includes an engagement path GLa and an extraction path GLb. The engagement path GLa is a groove-shaped path in which the second engaged portion 642*a* is guided to a position of engagement St in the process of mounting. The extraction path GLb is a groove-shaped path in which the second engaged portion 642*a* is guided after engagement is released. In the process of mounting, the second engaged portion 642*a* moves the engagement path GLa. The depth of the grooves of the engagement path GLa are shallower at the position of engagement St than an inlet portion 222, and hence the second engaged portion 642*a* is pushed down in a gravity downward direction. The body portion 647 is displaced toward the negative X-axis direction side against the biasing force of a spring at the position of engagement St. At the position of engagement St, the second engagement portion 232*a* formed by a wall portion of the second engagement structure 230*a* engages with the second engaged portion 642*a*. This engagement restricts movement of the cartridge 20*a* in the demounting direction.

Engagement between the second engagement portion 232*a* and the second engaged portion 642*a* is released by pushing the cartridge 20*a* in the mounting state toward the mounting direction. The second engagement portion 232*a* that has released from engagement moves the cartridge 20*a* in the demounting direction, to thereby move toward the inlet portion 222 in the extraction path GLb.

Figure 14:
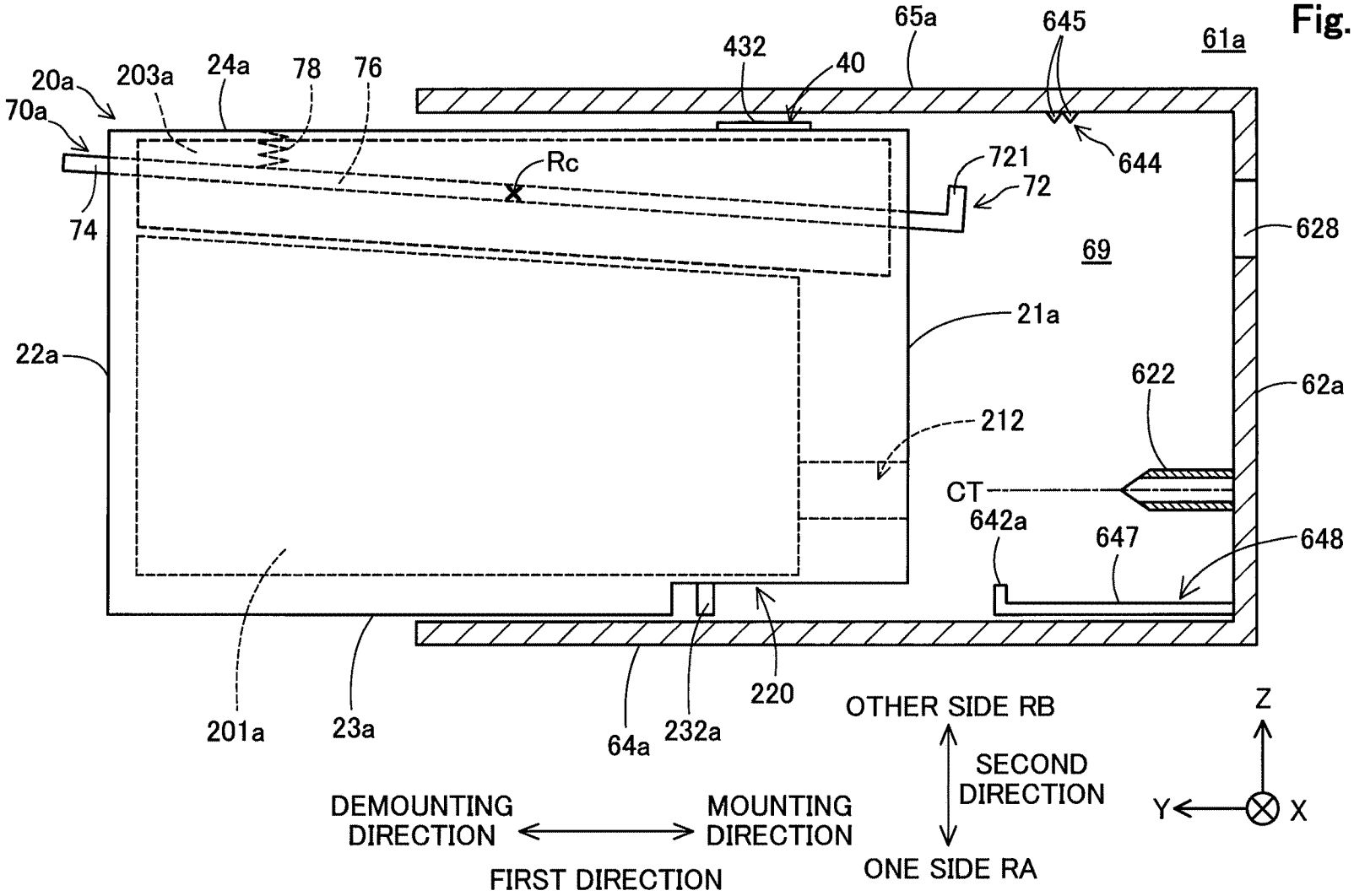
FIG. 14 is a diagram for illustrating a process of mounting the cartridge onto the holder unit.

FIG. 14 is a diagram for illustrating a process of mounting the cartridge 20*a* onto the holder unit 61*a*. When the cartridge 20*a* is to be mounted onto the holder unit 61*a*, the user displaces the operation portion 74 to the fourth wall portion 24*a* side, to thereby displace the first engagement portion 721 to the third wall portion 23*a* side by rotatably moving the first engagement portion 721 about the fulcrum Rc. In this state, the cartridge 20*a* is moved in the mounting direction toward the cartridge storage chamber 69.

Figure 15:
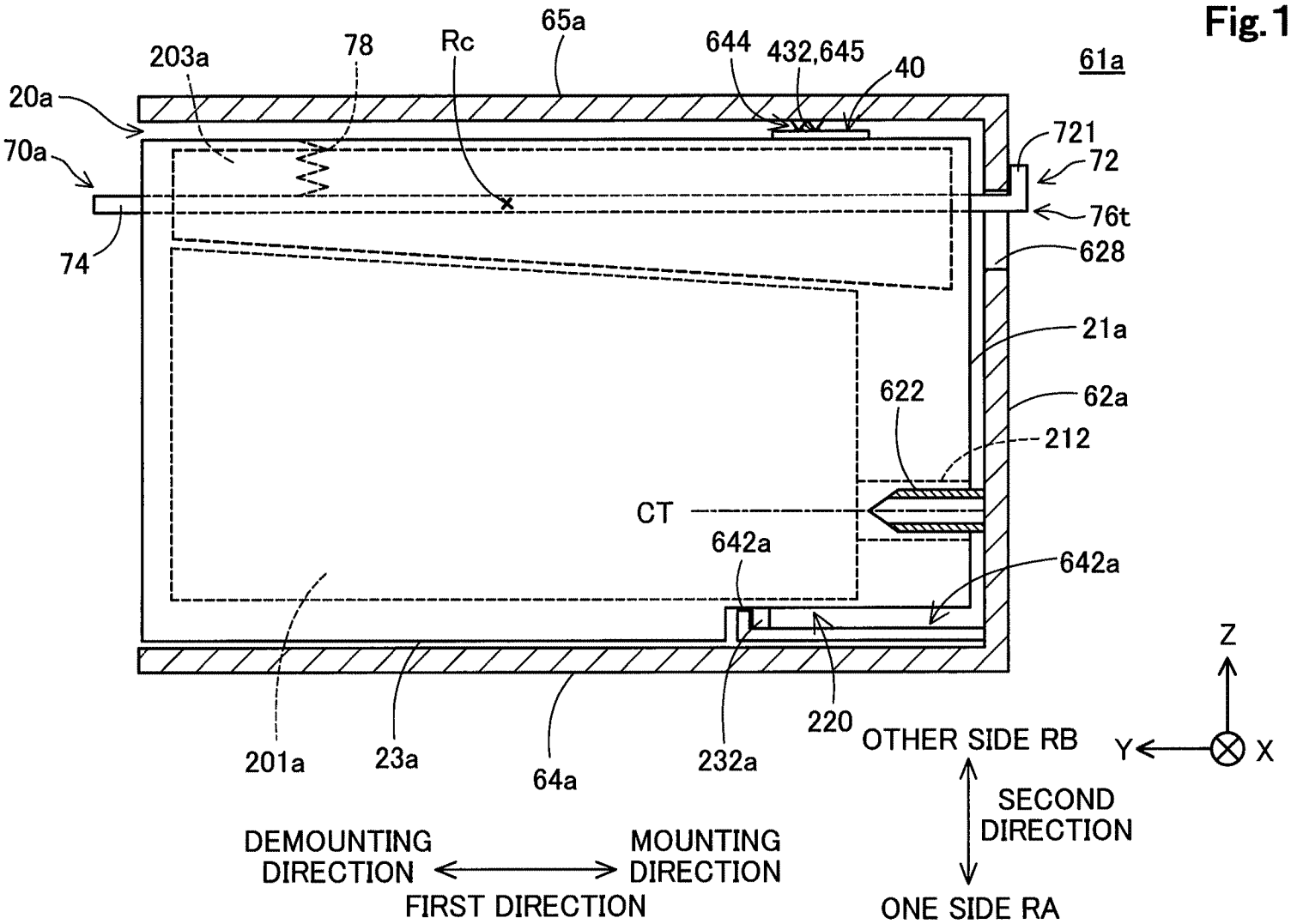
FIG. 15 is a diagram for illustrating a mounting state of the cartridge.

FIG. 15 is a diagram for illustrating a mounting state of the cartridge 20*a*. When the cartridge 20*a* is further moved in the mounting direction from the state illustrated in FIG. 14, the liquid introducing needle 622 connects with the liquid supply port 212, and the second engagement portion 232*a* engages with the second engaged portion 642*a*. In addition, the unit-side terminal 432 makes contact with the holder-side terminal 645. Further, the body portion 76 (more specifically, the one end side portion 76*t*) of the first engaged structure 70*a* is inserted into the first engaged portion 628. Then, the user removes his/her hand from the operation portion 74, to thereby cause the first engagement portion 721 to displace to the positive Z-axis direction side by the biasing force of the biasing member 78. With this configuration, the first engaged portion 628 and the first engagement portion 721 engage with each other.

The second embodiment has a similar configuration to that of the first embodiment, and hence achieves a similar effect. For example, as illustrated in FIG. 12, according to the second embodiment, the first engagement portion 721 is disposed at a position that overlaps with the outer shell 28*a* when the cartridge 20*a* is viewed from the demounting direction side. With this configuration, the possibility of the cartridge 20 in the mounting state inclining can be reduced compared to a case in which the first engagement portion 721 is not disposed at a position (for example, the fourth wall portion 24*a*) that overlaps with the outer shell 28*a*. In addition, because the first engagement portion 721 is disposed on the mounting direction side of the outer shell 28*a*, the cartridge 20*a* can be prevented from increasing in size in a direction orthogonal to the mounting direction. For example, the liquid supply port 212 is disposed on the one side RA in the second direction and the first engagement portion 721 is disposed on the other side RB in the second direction. With this configuration, the first engagement portion 721 and the first engaged portion 628 engage with each other on the other side RB in the second direction while the liquid supply port 212 and the liquid introducing needle 622 connect with each other on the one side RA in the second direction. In this embodiment, movement of the cartridge 20*a* in the demounting direction can be restricted on both sides in the second direction because the second engagement portion 232*a* is disposed on the one side RA and the first engagement portion 721 is disposed on the other side RB. With this configuration, the possibility of the cartridge 20 inclining can be reduced.

B-2. Modification Example of First Engaged Structure 70*a*A

The first engaged structure 70*a* used in the cartridge 20*a* is not limited to the configuration according to the second embodiment and may have another configuration provided that such a configuration allows engagement with the first engaged portion 628. An example of a first engaged structure 70*a*A as a modification example is described below.

Figure 16:
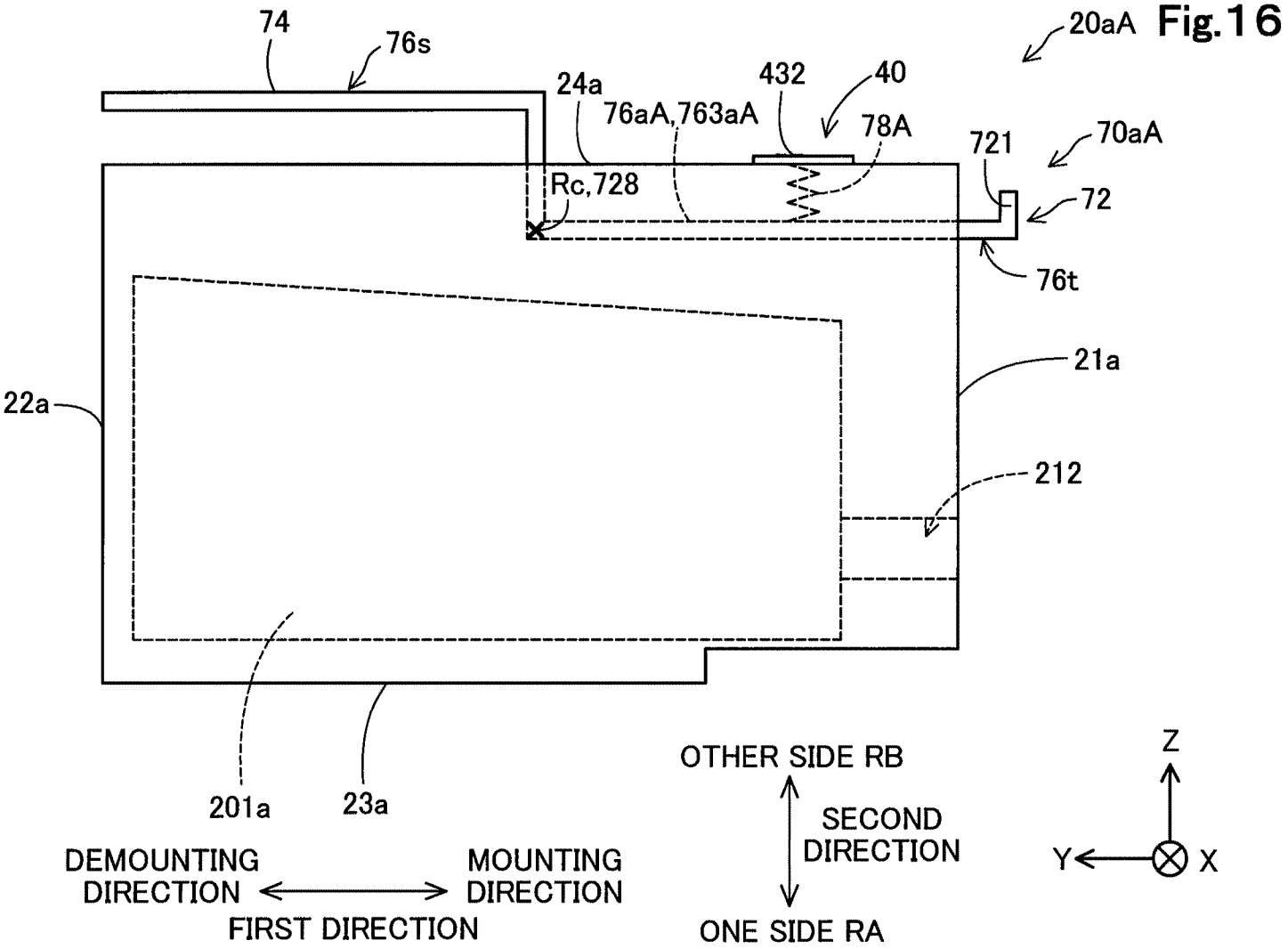
FIG. 16 is a diagram for explaining the first engagement structure as a modification example.

FIG. 16 is a diagram for explaining the first engagement structure 70*a*A according to a modification example. The first engaged structure 70*a*A and the first engaged structure 70*a* (FIG. 12) according to the second embodiment differ from each other in terms of configuration of a connecting portion 763*a*A, direction in which the operation portion 74 protrudes outward, and configuration of the biasing member 78A. Other configurations are the same as the first engaged structure 70*a*, and hence like components are denoted by like reference symbols and a description thereof is omitted. The outer shell 28*a* of the cartridge 20*a*A used in the first engaged structure 70*a*A has an opening (not shown) formed in the fourth wall portion 24*a*. Other configurations are the same as the cartridge 20*a* according to the second embodiment, and hence like components are denoted by like reference symbols and a description thereof is omitted.

A connecting portion 763*a*A of the first engaged structure 70*a*A has a plate-like shape that is bent partway at 90°. A fulcrum forming portion 728 is disposed at this bent portion to form a fulcrum Rc. The other end side portion 76*s* of a body portion 76*a*A protrudes outward from the opening of the fourth wall portion 24*a*. The biasing member 78A is a tension coil spring. The biasing member 78A biases the body portion 76A in the second direction in a direction extending from the third wall portion 23*a* to the fourth wall portion 24*a*. The user displaces the operation portion 74 in the direction that extends from the third wall portion 23*a* to the fourth wall portion 24*a* against biasing force of the biasing member 78A. With this configuration, the first engagement portion 721 rotates and is displaced toward the third wall portion 23 about the fulcrum Rc. Under the state in which the first engagement portion 721 is displaced, the user removes his/her hand from the operation portion 74 after the one end side portion 76*t* has been inserted into the first engaged portion 628 (FIG. 11) that forms an opening. As a result, the first engagement portion 721 is displaced to the positive Z-axis direction side (the fourth wall portion 24*a* side) by the biasing force of the biasing member 78A. With this configuration, the first engaged portion 628 and the first engagement portion 721 engage with each other.

C. Modification Examples

C-1. First Modification Example

Figure 17:
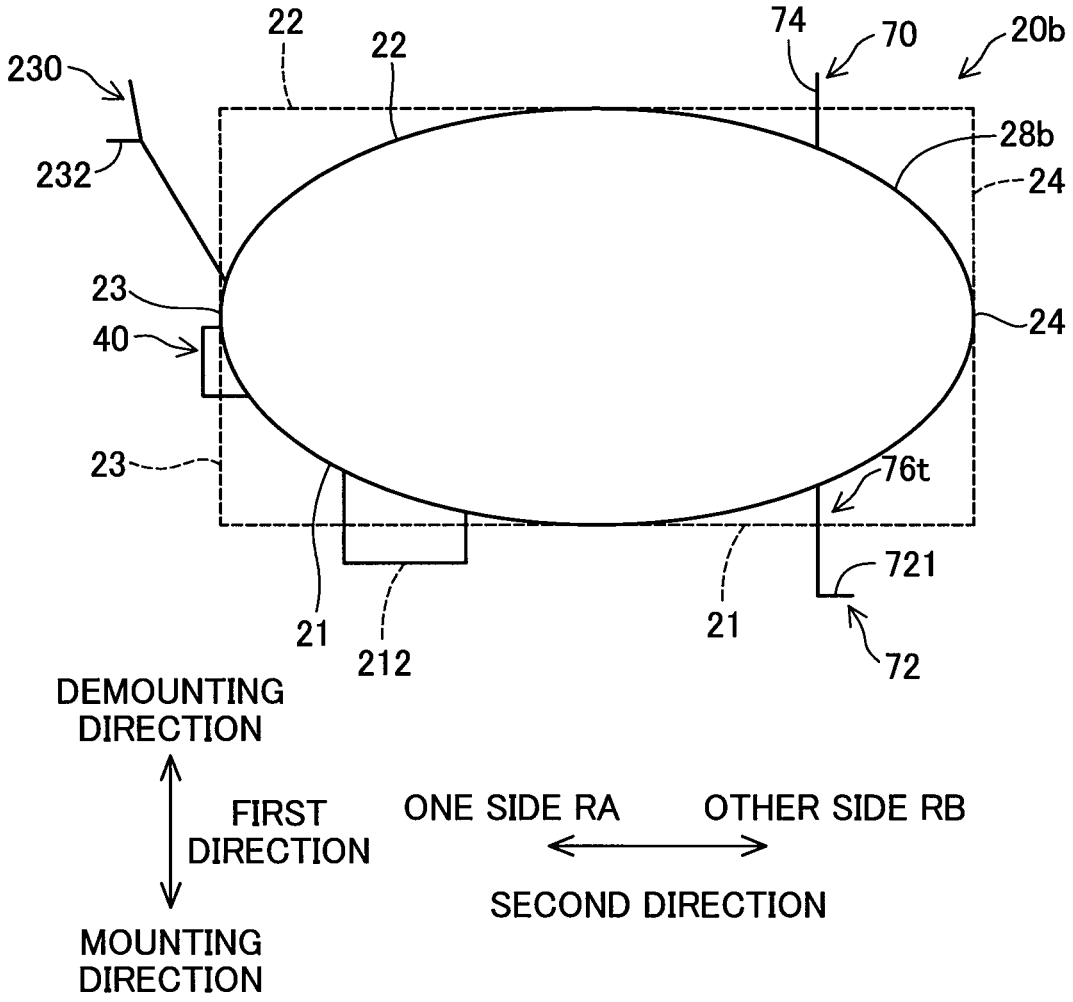
FIG. 17 is a conceptual view for illustrating a modification example of the shape of the cartridge.

FIG. 17 is a conceptual view for illustrating a modification example of the shape of the cartridge. FIG. 17 shows an exemplary modification example of the cartridge 20 according to the first embodiment. In the first and second embodiments, the outer shell 28, 28*a* of the cartridge 20, 20*a* has a substantially cuboid shape (FIGS. 4 and 12), but the shape thereof is not limited thereto and may be another shape provided that such a shape can be mounted onto a corresponding holder unit 61, 61*a*. The outer shell according to the first embodiment is indicated by a broken line in FIG. 17.

For example, as illustrated in FIG. 17, the outer shell 28*b* has an elliptical or rectangular side surface. This side surface has a constant width when the cartridge 20*b* is viewed from the front (left side in FIG. 17). The liquid supply port 212 is arranged in a tip side portion 21 of the outer shell 28*b* which faces a direction including a mounting direction component. The liquid supply port 212 is disposed on the one side RA in the second direction. The first engagement portion 721 is disposed on the mounting direction side of the tip side portion 21 of the outer shell 28*b* at a position that overlaps with the outer shell 28*b* when the cartridge 20*b* is viewed from the demounting direction side. The first engagement portion 721 is disposed on the other side RB in the second direction. The second engagement portion 232 and the circuit board 40 are disposed on the one side RA in the second direction.

As described above, the shape of the outer shell 28, 28*a* is not limited to the first and second embodiments provided that compatibility with the cartridge 20, 20*a* can be ensured.

C-2. Second Modification Example

Figure 18:
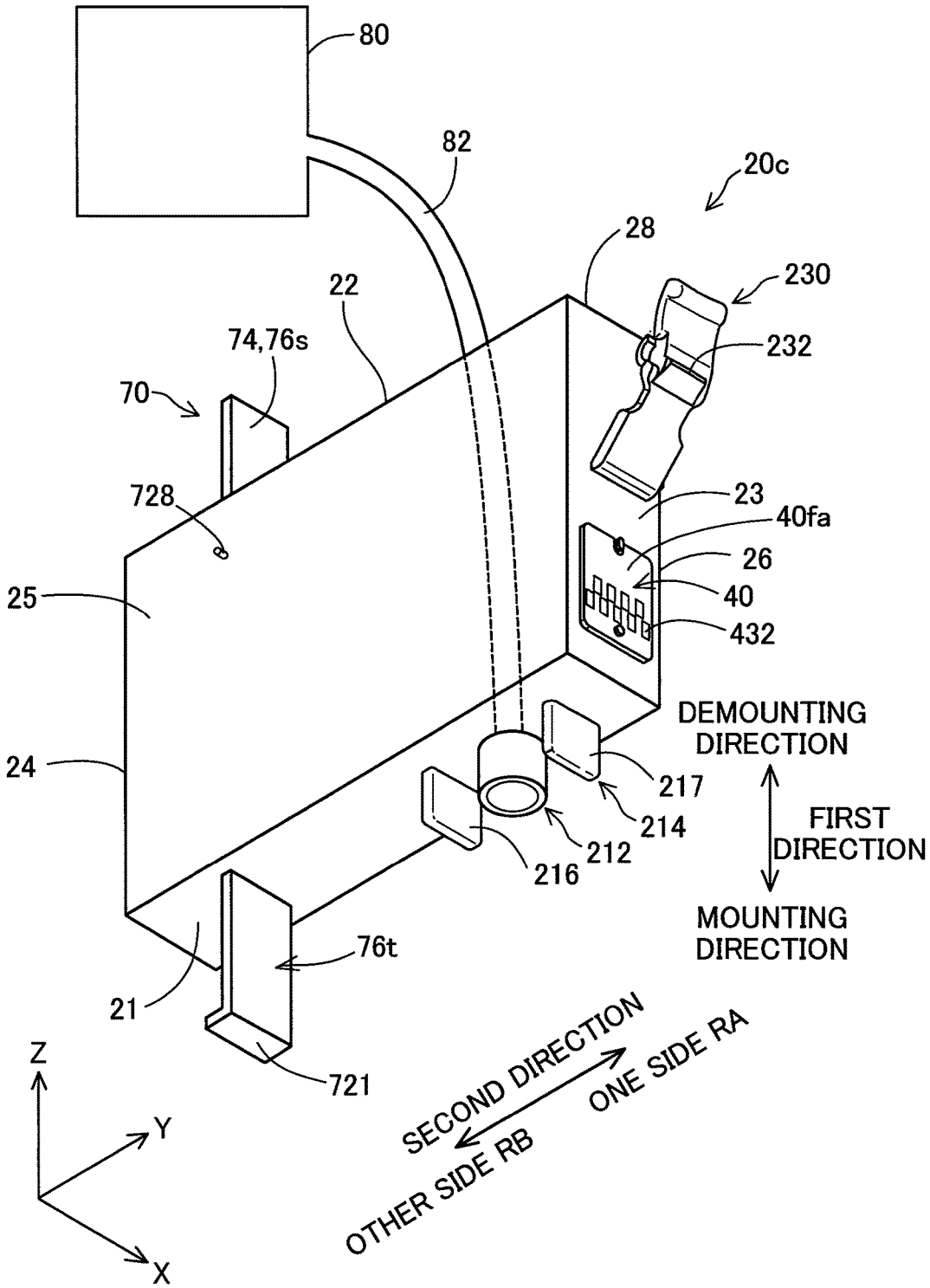
FIG. 18 is a diagram for explaining a modification example of a liquid supply unit.

FIG. 18 is a diagram for explaining a modification example of a liquid supply unit. In the first and second embodiments, the cartridge 20, 20*a* includes the liquid supply port 201, 201*a* inside the outer shell 28, 28*a*, but the position of the liquid supply port 201, 201*a* is not limited thereto. For example, as illustrated in FIG. 18, a tank 80 as a liquid supply port may be disposed on an outer side of the outer shell 28. This tank 80 is connected to the liquid supply port 212 via a tube 82.

C-3. Third Modification Example

In the first and second embodiments, the first engaged structure 70, 70*a* has a configuration in which the first engagement portion 721 engages with the first engaged portion 628 by rotating about the fulcrum Rc, but this configuration is not limited thereto and only needs to be a configuration that can engage with the first engaged portion 628. For example, the first engaged structure 70, 70*a* may have a configuration in which the operation portion 74 is pushed to the mounting direction side to displace the first engagement portion 721 and engage with the first engaged portion 628. In this case, the operation portion 74 is pulled to the demounting direction, to thereby displace the first engagement portion 721 from the position of engagement and release engagement between the first engagement portion 721 and the first engaged portion 628. In addition, for example, the first engaged structure 70, 70*a* may have a configuration in which the operation portion 74 is rotated and the first engagement portion 721 also rotates and displaces in conjunction with the motion of the operation portion 74, to thereby displace the first engagement portion 721 and engage with the first engaged portion 628. In this case, engagement between the first engagement portion 721 and the first engaged portion 628 is released by the operation portion 74 being rotated further than the engagement point.

The first engaged structure 70, 70*a* includes the operation portion 74, but does not need to include the operation portion 74 provided that the first engaged structure 70, 70*a* has such a configuration that the first engagement portion 721 can engage with the first engaged portion 628. For example, in the first embodiment, the first engaged structure 70 may be configured by only the one end side portion 76*t* that protrudes outward from the first wall portion 21. In this case, the one end side portion 76*t* may be configured to elastically deform in the second direction due to external force. The one end side portion 76*t* elastically deforms by coming into contact with the wall portion 62 in the process of mounting to be inserted into the first engaged portion 628. With this configuration, the first engagement portion 721 and the first engaged portion 628 engage with each other. In addition, the cartridge 20 moves in the demounting direction, to thereby cause the one end side portion 76*t* to come into contact with the wall portion 62 and elastically deform and engagement between the first engagement portion 721 and the first engaged portion 628 to be released.

C-4. Fourth Modification Example

In the first and second embodiments, the cartridge 20, 20*a* includes the second engagement portion 232, 232*a* and the circuit board 40 (FIGS. 4, 12 and 13), but may not include these components. In the first embodiment, the cartridge 20 includes the third engagement structure 214 (FIG. 4), but this may be omitted.

C-5. Fifth Modification Example

The present invention is not limited to an inkjet printer and a liquid supply unit for supplying ink to an inkjet printer, and can also be applied to any type of liquid ejection apparatus that ejects a liquid other than ink, and a liquid supply unit (cartridge) for storing such a liquid. For example, the present invention can be applied to the following types of liquid ejection apparatus and liquid supply units therefor.

(1) image recording device, such as a facsimile machine;
(2) color material ejection device used to manufacture color filters for an image display device, e.g., a liquid crystal display;
(3) electrode material ejection device used to form electrodes of, for example, an organic EL (electroluminescence) display and a field emission display (FED);
(4) fluid consuming device configured to eject a bioorganic material-containing fluid used for manufacturing biochips;
(5) sample ejection device used as a precision pipette;
(6) ejection device of lubricating oil;
(7) ejection device of a resin solution;
(8) fluid consuming device for pinpoint ejection of lubricating oil on precision machines such as watches or cameras;
(9) fluid consuming device configured to eject a transparent resin solution, such as an ultraviolet curable resin solution, onto a substrate in order to manufacture a hemispherical microlens (optical lens) used for, for example, optical communication elements;
(10) fluid consuming device configured to eject an acidic or alkaline etching solution in order to etch a substrate or the like; and
(11) fluid consuming device equipped with a fluid ejection head for ejecting a very small volume of droplets of any other fluid.

The "droplet" herein means the state of fluid ejected from the fluid consuming device and may be in a granular shape, a teardrop shape or a tapered threadlike shape. The "fluid" herein may be any material ejectable by the fluid consuming device. The "fluid" may be any material in the liquid phase. For example, liquid-state materials of high viscosity or low viscosity, sols, aqueous gels and other liquid-state materials having inorganic solvents, organic solvents, solutions, liquid resins and liquid metals (metal melts) are included in the "fluid". The "fluid" is not limited to the liquid state as one of the three states of matter but includes solutions, dispersions and mixtures of the functional solid material particles, such as pigment particles or metal particles, solved in, dispersed in or mixed with a solvent. Typical examples of the fluid include ink described in the above embodiment and liquid crystal. The ink herein includes general water-based inks and oil-based inks, as well as various fluid compositions, such as gel inks and hot-melt inks.

The invention is not limited to any of the embodiment, the examples and the modifications described herein but may be implemented by a diversity of other configurations without departing from the scope of the invention. For example, the technical features of the embodiment, examples and modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

REFERENCE SYMBOLS LIST

10, 10*a* . . . printer, 12 . . . platen, 13 . . . carriage motor, 14 . . . drive belt, 18 . . . transfer motor, 20, 20A, 20*a*, 20*a*A, 20*b* . . . cartridge, 21, 21*a* . . . first wall portion, 22, 22*a* . . . second wall portion, 23, 23*a* . . . third wall portion, 24, 24*a* . . . fourth wall portion, 25, 25*a* . . . fifth wall portion, 26, 26*a* . . . sixth wall portion, 28, 28*a*, 28*b* . . . outer shell, 29 . . . valve mechanism, 29A . . . sealing portion, 29B . . . valve element, 29C . . . biasing member, 37 . . . flexible cable, 38 . . . control unit, 39 . . . tube, 40 . . . circuit board, 40*fa* . . . front surface, 50 . . . head unit, 52 . . . carriage, 54 . . . head unit, 57 . . . liquid supply port, 60 . . . carriage unit, 61, 61*a* . . . holder unit, 62, 62*a* . . . pre-mounting wall portion, 64, 64*a* . . . first side wall portion, 65, 65*a* . . . second side wall portion, 66, 66*a* . . . third side wall portion, 67, 67*a* . . . fourth side wall portion, 69 . . . cartridge storage chamber, 69A to 69F . . . slot, 70, 70A, 70*a*, 70*a*A . . . first engaged structure, 74 . . . operation portion, 76, 76A, 76*a*A . . . body portion, 76*s* . . . other end side portion, 76*t* . . . one end side portion, 78, 78A . . . biasing member, 80 . . . tank, 82 . . . tube, 201, 201*a* . . . liquid storage portion, 203, 203*a* . . . engagement structure arrangement portion, 205 . . . communication hole, 206 . . . dividing wall, 212, 212*a* . . . liquid supply port, 214 . . . third engagement structure, 215 . . . first restricting portion, 216 . . . third engagement portion, 217 . . . fourth engagement portion, 219 . . . liquid supply arrangement port, 220 . . . air induction port, 222 . . . inlet portion, 223 . . . opening, 224 . . . opening, 230, 230*a* . . . second engagement structure, 232, 232*a* . . . second engagement portion, 432 . . . unit-side terminal, 622 . . . liquid introducing needle, 622*s* . . . case end, 622*t* . . . tip end, 624 . . . third engaged structure, 626 . . . first engaged wall portion, 627 . . . second engaged wall portion, 628 . . . first engaged portion, 642, 642*a* . . . second engaged portion, 644 . . . electrode portion, 645 . . . holder-side terminal, 647 . . . body portion, 648 . . . second engaged structure, 721 . . . first engagement portion, 728 . . . fulcrum forming portion, 763, 763A, 763*a*A . . . connecting portion, 1000, 1000*a* . . . liquid ejection system, CPa, CPb . . . central portion, CT . . . central axis, GLa . . . engagement path, GLb . . . extraction path, P . . . printing medium, Ps . . . external force, Pt . . . external force, RM . . . rotation direction, Rc . . . fulcrum, St . . . position of engagement.

What is claimed is:

1. A liquid supply unit that includes a liquid ejection apparatus and configured to be mounted onto a holder unit that has a liquid introducing needle that extends in a first direction, the liquid supply unit comprising:

an outer shell;

a liquid supply port disposed in the outer shell, the liquid supply port configured to connect to the liquid introducing needle; and an engagement structure including a first engagement portion, the first engagement portion configured to restrict movement in a demounting direction through engaging with the holder unit, the demounting direction opposite to a mounting direction parallel to the first direction, the mounting direction being a direction of mounting the liquid supply unit onto the holder unit, wherein the first engagement portion is disposed on a mounting direction side of the outer shell at a position that overlaps with the outer shell when the liquid supply unit is viewed from the demounting direction side.

2. The liquid supply unit in accordance with claim 1, wherein the liquid supply port is disposed on one side in a second direction orthogonal to the mounting direction, and the first engagement portion is disposed on an other side in the second direction in a mounting state in which the liquid supply unit is mounted onto the holder unit.

3. The liquid supply unit in accordance with claim 2, further comprising:

a second engagement portion that is disposed on the one side and that is configured to restrict movement of the liquid supply unit in the demounting direction through engaging with the holder unit.

4. The liquid supply unit in accordance with claim 1, wherein the engagement structure further includes an operation portion used for operating engagement between the first engagement portion and the holder unit.

5. The liquid supply unit in accordance with claim 4, wherein the operation portion protrudes outward from a portion of the outer shell different to a tip end portion that faces a direction including the mounting direction component.

6. The liquid supply unit in accordance with claim 5, wherein the operation portion protrudes outward in a direction including the demounting direction component from a portion of the outer shell that faces a direction including the demounting direction component.

7. The liquid supply unit in accordance with claim 4, wherein the engagement structure further includes:

a connecting portion that connects the first engagement portion and the operation portion to each other and that forms a fulcrum about which the first engagement portion and the operation portion rotatably move.

8. The liquid supply unit in accordance with claim 1, further comprising:

a unit-side terminal that is disposed on one side of the outer shell in a second direction orthogonal to the mounting direction and is configured to electronically connect to a holder-side terminal of the holder unit; and a third engagement portion that is arranged between the liquid supply port and the first engagement portion in the second direction and that is configured to restrict movement of the liquid supply unit from the one side to an other side in the second direction through engaging with the holder unit, wherein, in the mounting state of mounting the liquid supply unit onto the holder unit, the unit-side terminal is subject to a force from the one side to the other side from the holder-side terminal.

9. The liquid supply unit in accordance with claim 1, wherein the outer shell comprises:

a first wall portion on which the liquid supply port is disposed;

a second wall portion located on the demounting direction side opposing the first wall portion;

a third wall portion that intersects with the first wall portion and the second wall portion and is located on one side in the second direction orthogonal to the mounting direction; and a fourth wall portion that intersects with the first wall portion and the second wall portion and is located on the other side in the second direction opposing the third wall portion.

* * * * *